US010232627B2

(12) United States Patent
Toya et al.

(10) Patent No.: US 10,232,627 B2
(45) Date of Patent: Mar. 19, 2019

(54) CONTAINER, LIQUID EJECTING APPARATUS, LIQUID CONTAINER

(71) Applicant: SEIKO EPSON CORPORATION, Tokyo (JP)

(72) Inventors: Akihiro Toya, Matsumoto (JP); Yoshiaki Shimizu, Matsumoto (JP); Hiroyuki Kawate, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/660,778

(22) Filed: Jul. 26, 2017

(65) Prior Publication Data

US 2018/0043694 A1 Feb. 15, 2018

(30) Foreign Application Priority Data

Aug. 12, 2016 (JP) ..... 2016-158443
Oct. 17, 2016 (JP) ..... 2016-203331

(51) Int. Cl.
*B41J 2/175* (2006.01)

(52) U.S. Cl.
CPC ..... *B41J 2/1752* (2013.01); *B41J 2/17553* (2013.01)

(58) Field of Classification Search
CPC . B41J 15/00; B41J 15/04; B41J 15/044; B41J 15/046; B41J 2/1752; B41J 2/17523; B41J 2/17526; B41J 2/1753; B41J 2/17533; B41J 2/17536; B41J 2/1754; B41J 2/17556; B41J 2/17553; B41J 2/1755; B41J 2/17546; B41J 2/17543
See application file for complete search history.

(56) References Cited

U.S. PATENT DOCUMENTS 9,346,278 B2 5/2016 Ishizawa et al.
2007/0012707 A1* 1/2007 Rattay ..... A45F 3/18 220/762
2009/0290001 A1 11/2009 Domae
2011/0005400 A1* 1/2011 Tien ..... A47J 31/02 99/298
2013/0186513 A1 7/2013 Aoki et al.
2013/0240551 A1* 9/2013 Peacock ..... A47G 19/2205 220/766
2015/0070445 A1 3/2015 Kanbe et al.
2016/0096375 A1 4/2016 Ozeki

FOREIGN PATENT DOCUMENTS

JP 2007-230089 9/2007
JP 2009-279876 12/2009
JP 2017-043086 3/2017
WO 2015136933 A1 9/2015

OTHER PUBLICATIONS

European Search Report issued in Application No. 17185585 dated Dec. 20, 2017.

* cited by examiner

*Primary Examiner* — Kristal Feggins
(74) *Attorney, Agent, or Firm* — Workman Nydegger

(57) ABSTRACT

A container on which a liquid container provided with a handle is removably placed, in which the container includes a plurality of guide portions configured to guide guided portions provided in the liquid container in a guiding direction, and the plurality of guide portions are provided so that at least a part of the handle is disposed on a line which connects the at least two guide portions in a state where the liquid container is placed on the container.

19 Claims, 22 Drawing Sheets

CONTAINER, LIQUID EJECTING APPARATUS, LIQUID CONTAINER

BACKGROUND

1. Technical Field

The present invention relates to a container on which a liquid container containing a liquid is placed, a liquid ejecting apparatus on which the container is mounted and which ejects the liquid supplied from the liquid container, and the liquid container.

2. Related Art

An example of a liquid ejecting apparatus is a printing apparatus which ejects ink (a liquid) from a head (a liquid ejecting portion) onto a medium (see, for example, JP-A-2009-279876). This printing apparatus is provided with a tray (a container) to which an ink bag unit (a liquid container) containing ink is removably attached. When an ink cartridge constituted by the ink bag unit and the tray is inserted into a slot, the ink is supplied from the ink bag unit to the printing apparatus.

In this type of printing apparatus, an ink bag unit which has become empty is removed from the tray and is replaced with a new ink bag unit. However, the ink bag unit is not sufficiently rigid to maintain its form during attachment to and removal from the tray, and as a result, attachment and removal of the ink bag unit is difficult.

This issue affects not only a tray to which an ink bag unit containing ink is removably attached, a printing apparatus on which the tray is mounted, and an ink bag unit, but generally also a container on which a liquid container which contains a liquid is placed, a liquid ejecting apparatus on which the container is mounted, and a liquid container.

SUMMARY

An advantage of some aspects of the invention is that a container to and from which a liquid container can be easily attached and removed, a liquid ejecting apparatus, and a liquid container which can be easily attached to and removed from the container are provided.

Hereinafter, ways to resolve the issues above and the operations and effects thereof will be described.

A container according to an aspect of the invention is a container on which a liquid container provided with a handle is removably placed, wherein the container includes a plurality of guide portions configured to guide guided portions provided in the liquid container in a guiding direction, and the plurality of guide portions are provided so that at least a part of the handle is disposed on a line which connects the at least two guide portions in a state where the liquid container is placed on the container.

With this configuration, since the handle is disposed on the line which connects the guide portions, the liquid container in the state where the handle is gripped can be guided by the guide portions in a properly balanced manner. Therefore, the liquid container can be easily attached to and removed from the container.

A liquid ejecting apparatus according to another aspect of the invention desirably includes the container of the above configuration; a mounting portion on which the container is removably mounted; and a liquid ejecting portion configured to eject a liquid supplied from the liquid container placed on the container. With this configuration, the same effect as that of the container is produced.

A liquid container according to a further aspect of the invention is a liquid container placed on a container which is removably mounted on a liquid ejecting apparatus, including: a liquid containing portion capable of containing a liquid; a liquid supply portion configured to supply the liquid in the liquid containing portion to the liquid ejecting apparatus; and a handle provided in the liquid supply portion, wherein at least a part of the handle is positioned higher than the liquid supply portion in a state where the liquid container is placed on the container.

With this configuration, since at least a part of the handle is positioned higher than the liquid supply portion, it is easy to guide the user to grip the handle. The liquid container can be easily attached to and removed from the container by making the user grip the handle.

Desirably, the liquid container further includes a guided portion configured to be guided by a guide portion provided in the container, wherein at least a part of the handle is positioned higher than the guided portion in a state where the liquid container is placed on the container.

With this configuration, since at least a part of the handle is positioned higher than the guided portion, the liquid container can be guided by the guide portion and attached to and removed from the container in the state where the handle is gripped.

Desirably, the liquid container includes a plurality of guided portions, and at least a part of the handle is disposed on a line which connects at least two guided portions. With this configuration, since the handle is disposed on the line which connects the guided portions, the liquid container in the state where the handle is gripped can be attached to and removed from the container while being guided by the guide portions in a properly balanced manner.

Desirably, in the liquid container, the handle and the liquid supply portion are provided as separate members and the handle is movable with respect to the liquid supply portion. With this configuration, since the handle and the liquid supply portion are provided as separate members, a degree of freedom in design, such as the shape and the range of movement of the handle, is increased.

Desirably, in the liquid container, the handle is formed integrally with the liquid supply portion and is displaceable. With this configuration, since the handle and the liquid supply portion are formed integrally with each other, the manufacturing cost is kept down.

Desirably, the liquid container includes a plurality of guided portions configured to be guided in the guiding direction by the guide portions provided in the container, the handle is movable by pivoting about a rotating shaft axis provided in the liquid supply portion, and the rotating shaft axis is disposed on a line which connects at least two guided portions.

With this configuration, the rotating shaft axis is disposed on the line which connects the guided portions. Therefore, the liquid container in the state where the handle is gripped can be attached to and removed from the container while being guided by the guide portions in a properly balanced manner.

A liquid container according to a further aspect of the invention is a liquid container placed on a container which is removably mounted on a liquid ejecting apparatus, including: a liquid containing portion capable of containing a liquid; a liquid supply portion configured to supply the liquid in the liquid containing portion to the liquid ejecting apparatus; a handle provided in the liquid supply portion; and a guided portion configured to be guided by the guide portions provided in the container, wherein at least a part of the handle is movable to a position higher than the guided portion in a state where the liquid container is placed on the container.

With this configuration, at least a part of the handle is movable to a position higher than the guided portion. Therefore, the handle is easy to grip, and the liquid container can be easily attached to and removed from the container.

A liquid ejecting apparatus according to a further aspect of the invention is a liquid ejecting apparatus provided with a container on which the liquid container of the above configuration is removably placed, wherein at least a part of the handle projects from an opening of the container in a state where the liquid container desirably is placed on the container.

With this configuration, since at least a part of the handle projects from the opening of the container, it is easy to guide the user to grip the handle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus will be described with reference to the drawings. The liquid ejecting apparatus is, for example, an ink jet printer which performs recording (i.e., printing) by ejecting ink, which is an example of a liquid, onto a medium, such as a paper sheet.

Figure 1:
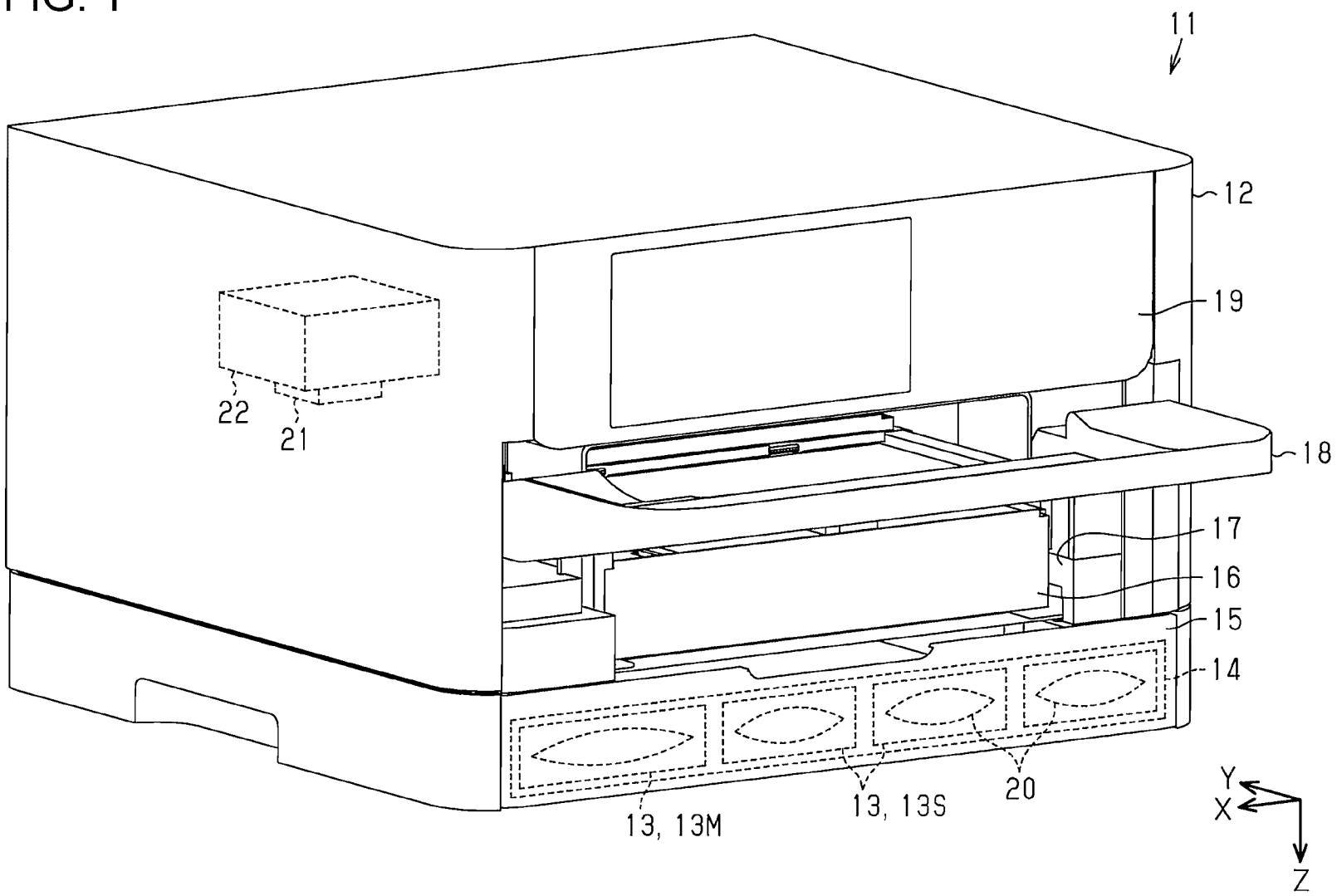
FIG. 1 is a perspective view of a liquid ejecting apparatus according to an embodiment.

As illustrated in FIG. 1, a liquid ejecting apparatus 11 includes a substantially rectangular parallelepiped housing 12. On a front surface of the housing 12, a pivotable front lid 15 is disposed on a bottom side and an attachment opening 17 is disposed above the front lid 15. The front lid 15 covers a mounting portion 14 on which containers 13 are removably mounted. A cassette 16 capable of accommodating a medium (not illustrated) is attached to the attachment opening 17. A discharge tray 18 onto which a medium is discharged, and an operation panel 19 on which operations with respect to the liquid ejecting apparatus 11 are performed are disposed above the attachment opening 17. The front surface of the housing 12 is a side surface which has a height and a width and on which a user performs operations with respect to the liquid ejecting apparatus 11.

A plurality of containers 13 having different widths may be mounted on the mounting portion 14 of the present embodiment while being arranged in line in the width direction. For example, as a plurality of containers 13, three or more containers 13 including a first container 13S and a second container 13M, which is wider than the first container 13S, are mounted on the mounting portion 14. A liquid container 20 is removably placed on each of these containers 13. That is, the liquid container 20 is placed on the container 13 which is removably mounted on the liquid ejecting apparatus 11. The container 13 is removably mounted on the mounting portion 14 when no liquid container 20 is held thereon and is a component of the liquid ejecting apparatus 11.

In the housing 12, a liquid ejecting portion 21 which ejects a liquid through nozzles and a carriage 22 which reciprocates in a scanning direction, which coincides with the width direction of the liquid ejecting apparatus 11, are provided. The liquid ejecting portion 21 is moved with the carriage 22 and ejects the liquid supplied from the liquid containers 20 placed on the containers 13 onto the medium, such that printing is performed on the medium.

In the present embodiment, a direction which (desirably orthogonally) crosses a moving path of the container 13 when mounted on the mounting portion 14 is defined as a width direction, and a direction in which the moving path extends is defined as a depth direction. The width direction and the depth direction substantially extend in a horizontal plane. In the drawings, the gravity direction is indicated by the Z-axis when the housing 12 is placed on a horizontal plane, and the moving direction of the containers 13 upon attachment to the mounting portion 14 is indicated by the Y-axis. The moving direction may also be referred to as an attaching direction with respect to the mounting portion 14 or as an inserting direction in the accommodation space. The direction opposite to the moving direction may also be referred to as a removing direction. The width direction is indicated by the X-axis, which orthogonally crosses the Z-axis and the Y-axis. The width direction, the gravity direction, and the attaching direction (desirably orthogonally) cross one another. Each of these directions is used to denote respective width, height, and depth dimensions.

Figure 2:
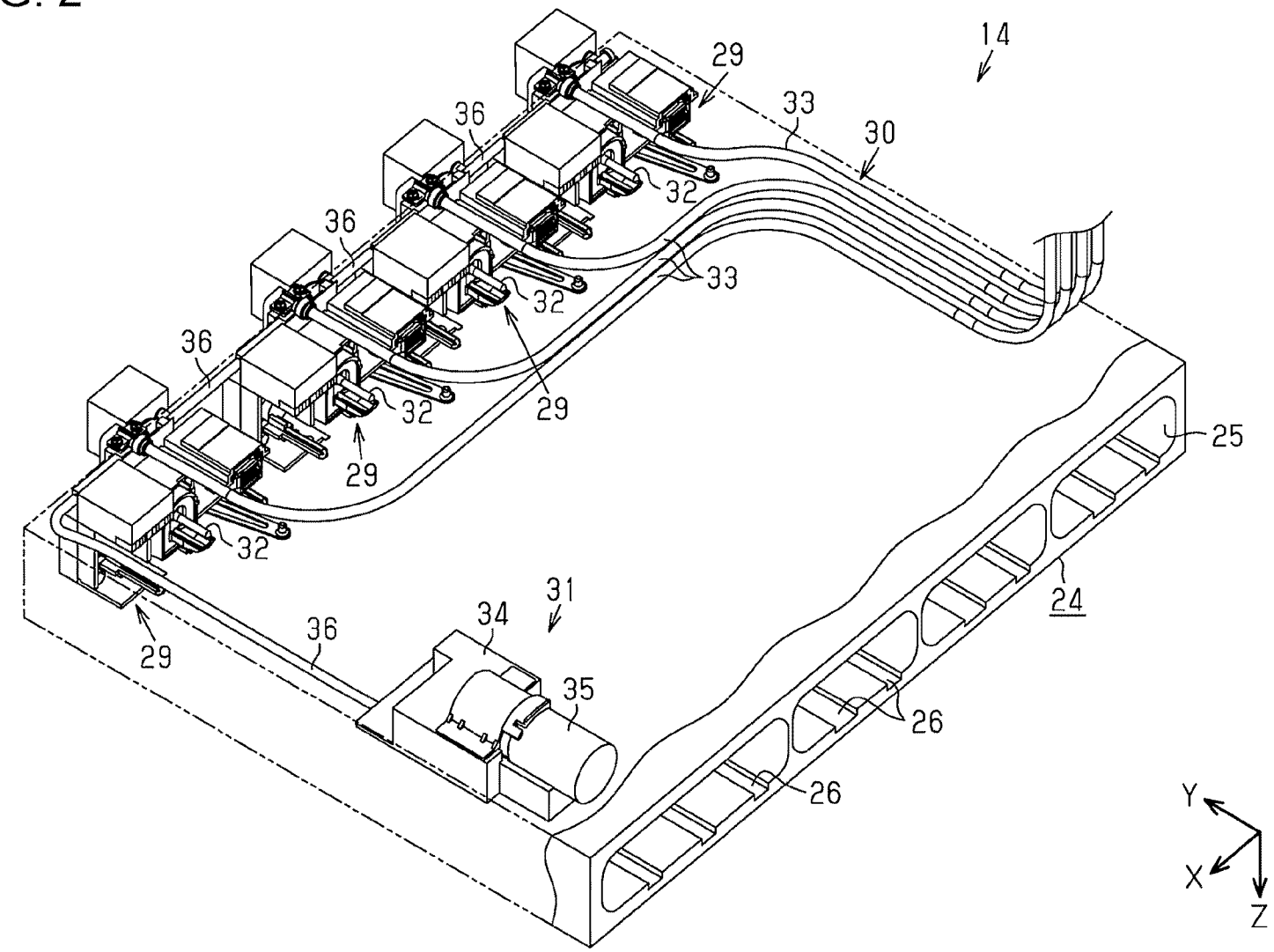
FIG. 2 is a perspective view of a mounting portion provided in the liquid ejecting apparatus of FIG. 1.

As illustrated in FIGS. 1 and 2, the mounting portion 14 includes a frame 24 which forms an accommodation space capable of accommodating one or a plurality of (four in the present embodiment) containers 13. The frame 24 forms insertion ports 25 communicating with the accommodation space from a front side which is the front lid 15 side. The frame 24 desirably has a plurality of sets of linear guide rails 26 extending in the depth direction for guiding the movement of the containers 13 during attachment and removal. The guide rails 26 are one projection or recess or projections or recesses.

The containers 13 are inserted into the accommodation space through the insertion ports 25 and are moved along the moving paths extending in the depth direction. Then, the containers 13 are mounted on the mounting portion 14. Regarding the frame 24, only the portion near a front plate which forms the insertion ports 25 is depicted by a solid line in FIG. 2.

Figure 3:
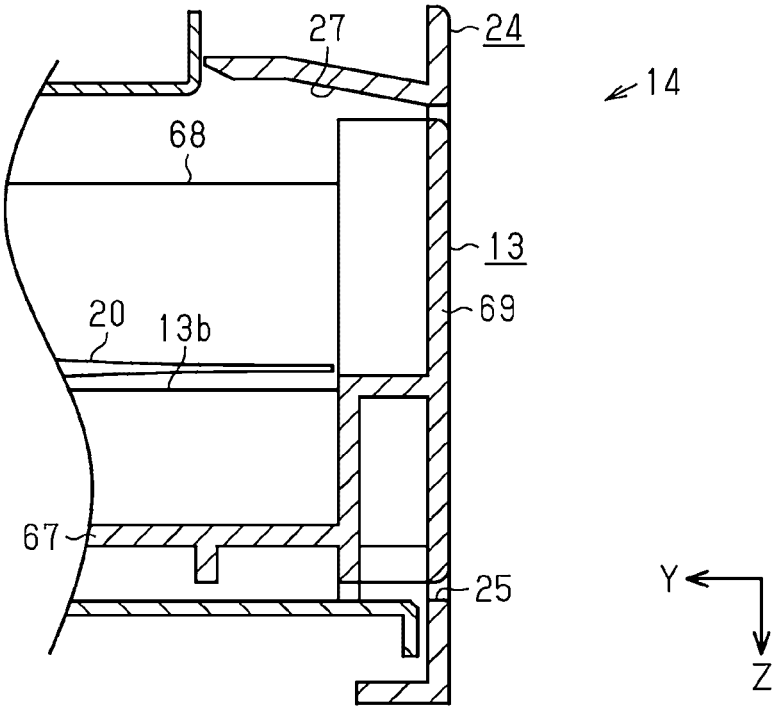
FIG. 3 is a cross-sectional view of an insertion port in the mounting portion of FIG. 2.

As illustrated in FIG. 3, the frame 24 is formed so that a ceiling surface 27 which constitutes an upper surface of the insertion port 25 in the vertical direction is a downward slope sloping in a removing direction (from a rear side to the front side). As illustrated in FIG. 2, one or a plurality of (four in the present embodiment) connection mechanisms 29 are provided on the rear portion of the accommodation space to correspond to each of the containers 13. The liquid ejecting apparatus 11 further includes supply flow channels 30 which supply the liquid toward the liquid ejecting portion 21 from the liquid containers 20 mounted on the mounting portion 14 together with the containers 13, and a supply mechanism 31 configured to send the liquid contained in the liquid containers 20 to the supply flow channels 30.

A corresponding one of the supply flow channels 30 is provided for each type (corresponding to each color in the present embodiment) of the liquid and includes a connecting portion 32 which forms an upstream end to which the liquid container 20 is connected, and a flexible supply tube 33. A pump chamber (not illustrated) is provided between the connecting portion 32 and the supply tube 33. A downstream end of the connecting portion 32 and an upstream end of the supply tube 33 communicate with the pump chamber. A flexible film (not illustrated) separates the pump chamber from a pressure regulating chamber (not illustrated).

The supply mechanism 31 includes a pressure regulating mechanism 34, a driving source 35 of the pressure regulating mechanism 34, and a pressure regulating flow channel 36 which connects the pressure regulating mechanism 34 and the pressure regulating chamber. When the pressure regulating mechanism 34 reduces pressure in the pressure regulating chamber through the pressure regulating flow channel 36 by driving the driving source 35 (for example, a motor), the flexible film is bent and displaced toward the pressure regulating chamber, and the pressure in the pump chamber is reduced. With the reduction in the pressure in the pump chamber, the liquid contained in the liquid container 20 is sucked into the pump chamber through the connecting portion 32. This phenomenon is referred to as suction driving. Then, when the pressure regulating mechanism 34 releases the pressure-reduction state in the pressure regulating chamber through the pressure regulating flow channel 36, the flexible film is bent and displaced toward the pump chamber, and the pressure in the pump chamber is increased. Then, as the pressure in the pump chamber increases, the liquid in the pump chamber flows into the supply tube 33 in a pressurized state. This phenomenon is referred to as ejection driving. The supply mechanism 31 supplies the liquid to the liquid ejecting portion 21 from the liquid container 20 by alternately repeating the suction driving and the ejecting driving.

Figure 4:
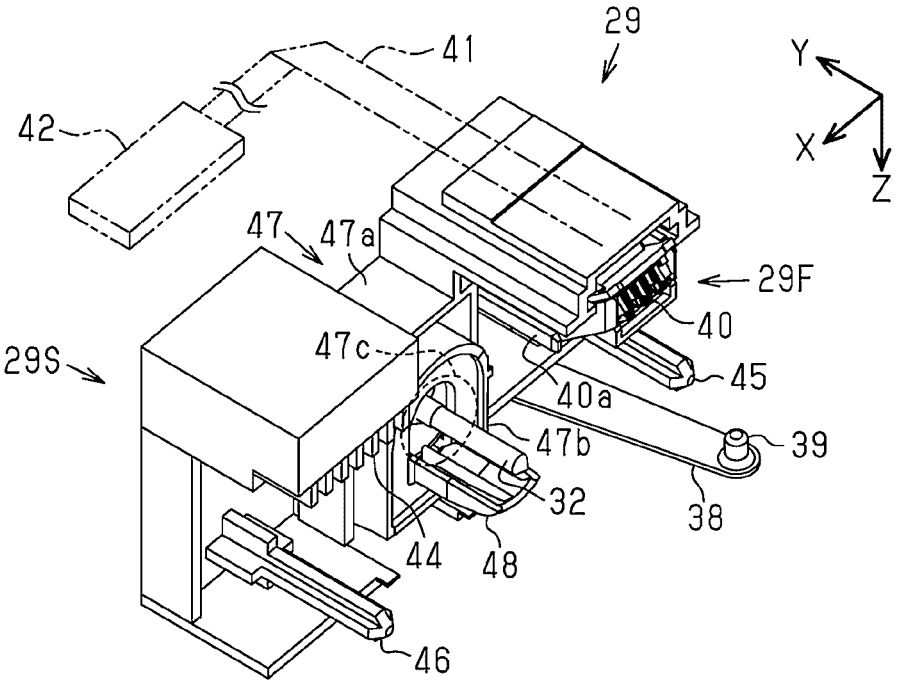
FIG. 4 is a perspective view of a connection mechanism provided in the mounting portion of FIG. 2.

Next, a configuration of the connection mechanism 29 will be described in detail. As illustrated in FIG. 4, the connection mechanism 29 has a first connection mechanism 29F and a second connection mechanism 29S disposed on both sides of the connecting portion 32 in the width direction. The first connection mechanism 29F includes an arm 38 projecting in the removing direction below the connecting portion 32 in the vertical direction. A latching portion 39 is provided at a distal end of the arm 38. The arm 38 is pivotable about a base end thereof. The latching portion 39 projects vertically upward from the arm 38, for example, and is disposed on the moving path of the container 13 upon attachment to the mounting portion 14 (see FIG. 2).

The first connection mechanism 29F further includes a terminal portion 40 which is disposed on the upper side of the connecting portion 32 in the vertical direction and projects in the removing direction. The terminal portion 40 is connected to a control device 42 via an electric line 41, such as a flat cable. An upper end of the terminal portion 40 desirably projects further than a lower end in the removing direction and faces diagonally downward. On both sides of the terminal portion 40 in the width direction, a pair of guide projections 40*a* is desirably provided to project in the width direction and extend in the attaching direction.

The second connection mechanism 29S desirably includes a block 44 for suppressing improper insertion that projects in the removing direction on the upper side of the connecting portion 32 in the vertical direction. The block 44 has projections and recesses facing downward, and the shape of the projections and recesses differ for each connection mechanism 29.

The connection mechanism 29 includes a pair of positioning projections 45 and 46, a pressing mechanism 47 disposed to surround the connecting portion 32, and a liquid receiving portion 48 projecting in the removing direction on the lower side of the connecting portion 32. A pair of positioning projections 45 and 46 is disposed such that one member of the pair is disposed on one side of the connecting portion 32 and the other member of the pair is disposed on the other side of the connecting portion 32 in the width direction so as to be included in the first connection mechanism 29F and the second connection mechanism 29S, respectively. The positioning projections 45 and 46 may be bar-shaped projections projecting in parallel in the removing direction, for example. Projection lengths of the positioning projections 45 and 46 in the removing direction are desirably longer than a projection length of the connecting portion 32 in the removing direction.

The pressing mechanism 47 includes a frame member 47*a* surrounding a base end portion of the connecting portion 32, a pressing portion 47*b* projecting from the frame member 47*a* in the removing direction, and an urging portion 47*c* urging the container 13 in the removing direction via the pressing portion 47*b*. The urging portion 47*c* may be a coil spring disposed between the frame member 47*a* and the pressing portion 47*b*, for example.

Figure 5:
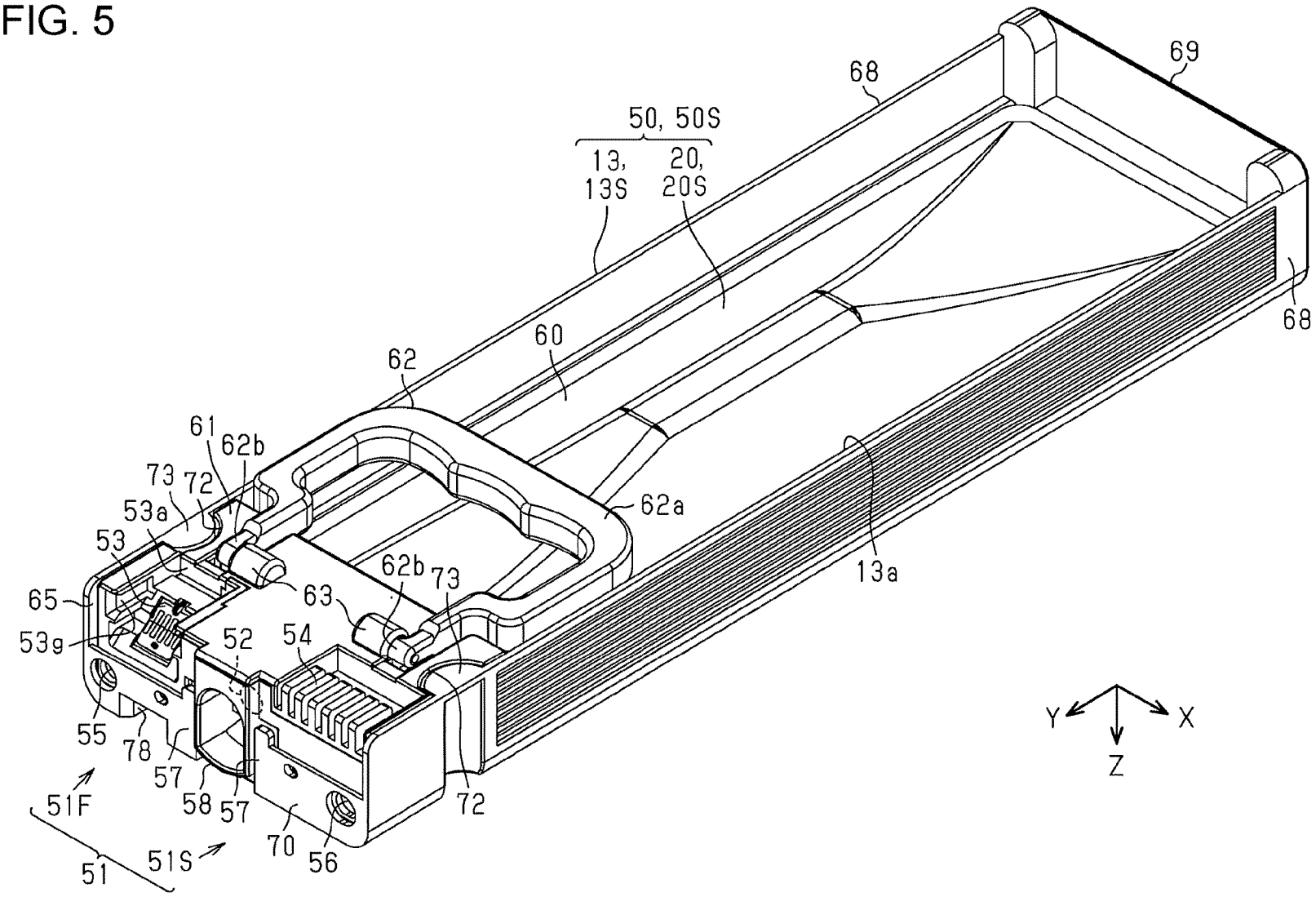
FIG. 5 is a perspective view of a first attachment mounted on the mounting portion of FIG. 2.

As illustrated in FIG. 5, in the present embodiment, the attachment 50 is constituted by the substantially rectangular parallelepiped container 13 and the liquid container 20 placed on the container 13. If a forward end of the attachment 50 upon attachment to the mounting portion 14 (see FIG. 2) is defined as a forward end and an end opposite to the forward end is defined as a base end, the attachment 50 includes a connection structure 51 at the forward end. The connection structure 51 has a first connection structure 51F and a second connection structure 51S on both sides of the supply port 52 in the width direction.

The first connection structure 51F includes a connection terminal 53 disposed on the upper side of the supply port 52 in the vertical direction. The connection terminal 53 is provided on a surface of a circuit board, for example, and the circuit board includes a storage unit for storing various types of information about the liquid container 20 (for example, the type of the liquid container 20, and liquid capacity).

The connection terminal 53 is desirably disposed to face diagonally upward in a recess 53*a* which opens upward in the attaching direction. Guide recesses 53*g* extending in the attaching direction are desirably disposed on both sides of the connection terminal 53 in the width direction.

The second connection structure 51S desirably includes an identification member 54 for suppressing improper insertion disposed on the upper side of the supply port 52 in the vertical direction. The identification member 54 has projections and recesses to fit the block 44 (see FIG. 4) of the connection mechanism 29 to be connected.

The connection structure 51 includes a pair of positioning holes 55 and 56, an urging force receiving portion 57 which receives the urging force of the urging portion 47*c* (see FIG. 4), and an inserting portion 58 extending on the lower side of the supply port 52. The positioning holes 55 and 56 are disposed on both sides of the supply port 52 in the width direction so as to be included in the first connection structure 51F and the second connection structure 51S, respectively. The first positioning hole 55 included in the first connection structure 51F is desirably a circular hole, whereas the second positioning hole 56 included in the second connection structure 51S is desirably a substantially laterally elongated circle extending in the width direction.

Figure 6:
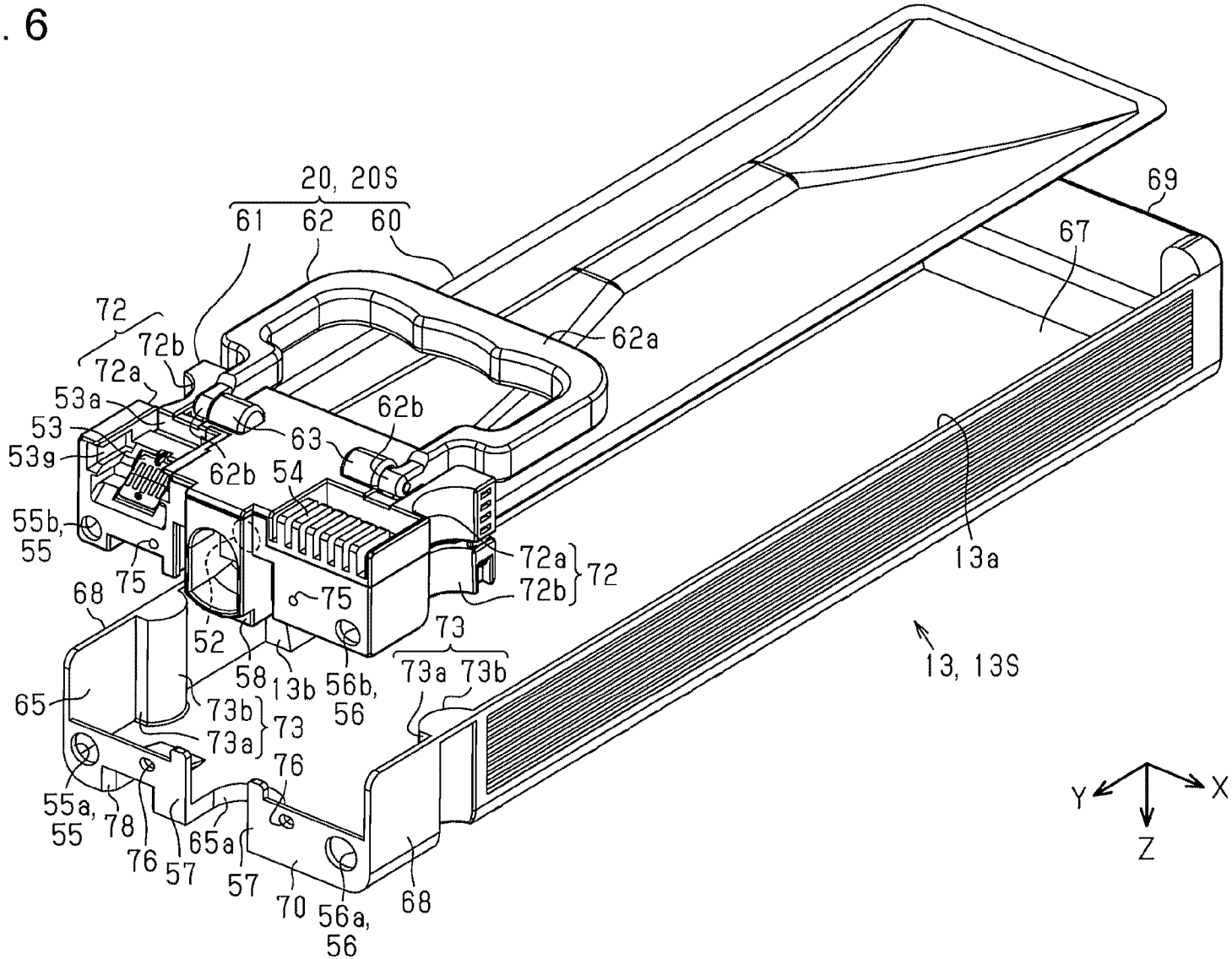
FIG. 6 is a perspective view of a first liquid container and a first container which constitute the first attachment of FIG. 5.

As illustrated in FIG. 6, a notch 65*a* to engage the inserting portion 58 of the liquid container 20 is formed at an end of the container 13. A first hole 55*a* and a second hole 56*a* are formed on both sides of the notch 65*a* in the width direction, and a first hole 55*b* and a second hole 56*b* are formed at an end of the liquid container 20. When the liquid container 20 is placed on the container 13, the first hole 55*a* and the first hole 55*b* are aligned in the depth direction and the second hole 56*a* and the second hole 56*b* are aligned in the depth direction. The first positioning hole 55 is constituted by the first holes 55*a* and 55*b*, and the second positioning hole 56 is constituted by the second holes 56*a* and 56*b*.

The liquid container 20 includes a liquid containing portion 60 capable of containing a liquid, a liquid supply portion 61 provided with the supply port 52 through which the liquid in the liquid containing portion 60 is supplied to the liquid ejecting apparatus 11, and a handle 62 provided in the liquid supply portion 61. The handle 62 and the liquid supply portion 61 are provided as separate members, and the handle 62 is movable with respect to the liquid supply portion 61. In particular, the handle 62 is movable by pivoting about a shaft coupling 63 provided in the liquid supply portion 61. The shaft coupling 63 is formed to open on both sides in the width direction, and bottomed semi-cylindrical portions thereof protrude from an upper surface of the liquid supply portion 61.

The handle 62 includes a gripping portion 62*a* which is gripped by a user. The gripping portion 62*a* is positioned closer to a base end which is separated from the liquid supply portion 61 in the depth direction than a shaft portion 62*b* which is pivotally supported by the shaft coupling 63. The handle 62 can pivot to take a first position in which the gripping portion 62*a* and the shaft coupling 63 are positioned at substantially the same height and a second position in which the gripping portion 62*a* is positioned higher than the shaft coupling 63 compared with the first position. For example, in the first position, the gripping portion 62*a* and the shaft coupling 63 may be at the same height, the gripping portion 62*a* may be positioned lower than the shaft coupling 63, or the gripping portion 62*a* may be positioned slightly higher than the shaft coupling 63.

The liquid containing portion 60 of the present embodiment is formed as a bag constituted by two rectangular laminated film materials with four sides joined. The liquid supply portion 61 is attached to a short side on a forward end side.

The container 13 includes, at a forward end portion thereof, an engagement receiving portion 65 with which the liquid supply portion 61 of the liquid container 20 is engageable. The liquid supply portion 61 of the liquid container 20 includes the connection terminal 53, the recess 53*a*, the guide recesses 53*g*, the identification member 54, the first hole 55*b*, and the second hole 56*b*. The engagement receiving portion 65 of the container 13 includes the urging force receiving portion 57, the first hole 55*a*, and the second hole 56*a*. The liquid supply portion 61 is positioned at the forward end portion of the container 13 when the liquid supply portion 61 engages the engagement receiving portion 65.

Next, with reference to FIGS. 4 and 5, a connection of the connection structure 51 provided in the attachment 50 with respect to the connection mechanism 29 will be described. When the attachment 50 is inserted into the accommodation space and the forward end approaches the connection mechanism 29, forward ends of the positioning projections 45 and 46 with long projection lengths in the removing direction are inserted into the positioning holes 55 and 56 of the attachment 50. The attachment 50 thus engages, and movement thereof in the width direction is restricted. Since the second positioning hole 56 is a substantially laterally elongated circle extending in the width direction, the positioning projection 45 inserted into the circular first positioning hole 55 is a positioning reference.

After the positioning projections 45 and 46 engage the positioning holes 55 and 56, the attachment 50 is moved further toward the rear side, the urging force receiving portion 57 comes into contact with the pressing portion 47*b* and receives an urging force of the urging portion 47*c*, such that the supply port 52 of the liquid container 20 is connected to the connecting portion 32. Thus, the positioning projections 45 and 46 enable desirable positioning of the attachment 50 before the connecting portion 32 is connected to the supply port 52.

When the attachment 50 is inserted into the correct position, the identification member 54 fits properly into the block 44 of the connection mechanism 29. If the attachment 50 is to be mounted on an incorrect position, the identification member 54 does not fit in the block 44 and the attachment 50 does not move further in the rear direction. Therefore, improper attachment is suppressed.

When the attachment 50 is moved in the attaching direction, the terminal portion 40 enters the recess 53*a* of the attachment 50, and the guide recesses 53*g* are guided by the guide projections 40*a*. Therefore, the positions are adjusted and the terminal portion 40 touches the connection terminal 53. Then, the connection terminal 53 is electrically connected to the terminal portion 40 and information is transmitted and received between the circuit board and the control device 42. The first positioning hole 55 as the positioning reference is desirably disposed in the first connection structure 51F which includes the connection terminal 53 (as one of the first connection structure 51F and the second connection structure 51S).

When the supply port 52 of the liquid container 20 is connected to the connecting portion 32 so that the liquid can be supplied and the connection terminal 53 comes into contact with the terminal portion 40 and is electrically connected thereto, the connection of the connection structure 51 with respect to the connection mechanism 29 is completed.

Next, desirable configurations of the liquid container 20 and the container 13 and an engagement structure between the liquid container 20 and the container 13 will be described in detail. A position of the attachment 50 when the attachment 50 is mounted on the mounting portion 14 (see FIG. 2) is defined as an attachment position of the attachment 50. A position of the liquid container 20 when the liquid supply portion 61 engages the engagement receiving portion 65 of the container 13 while in an attachment position is defined as an attachment position of the liquid container 20. When the liquid container 20 is in the attachment position, the inserting portion 58 projects vertically downward from the supply port 52.

As illustrated in FIG. 6, the container 13 includes a bottom plate 67 constituting a bottom surface, side plates 68 provided to stand vertically upright from both ends in the width direction of the bottom plate 67, a front plate 69 provided to stand vertically upright from a base end of the bottom plate 67, and a forward plate 70 provided to stand vertically upright from a forward end of the bottom plate 67.

In the container 13, the bottom plate 67, the side plates 68, the front plate 69, and the forward plate 70 constitute a main body which forms the accommodation space which accommodates the liquid container 20. The container 13 has an opening 13*a* through which the liquid container 20 is placed into or removed from the accommodation space. In the present embodiment, the opening 13*a* of the container 13 opens in a different direction to a direction in which the container 13 moves upon attachment to the mounting portion 14 (the attaching direction) (i.e., a vertically upward direction in the attachment position). A support projection 13*b* which supports an outer edge portion of the liquid container 20 may be provided at an inner portion of the container 13 at which the bottom plate 67 and the side plates 68 cross each other.

In the liquid supply portion 61 of the first liquid container 20S, a plurality of guided portions 72 are provided as recesses which open in the width direction in the attachment position. In the present embodiment, two guided portions 72 are arranged in the width direction.

In the engagement receiving portion 65 of the first container 13S, a plurality of guide portions 73 are provided to extend in a guiding direction which crosses the attaching direction (the vertical direction in the attachment position) and protrude inward of the container 13 from the side plates 68. In the present embodiment, two guide portions 73 are arranged in the width direction. The guiding direction is a direction which (desirably orthogonally) crosses the bottom plate 67 or the opening 13*a* and extends in the side plates 68.

The guide portions 73 provided in the container 13 guide the guided portions 72 provided in the liquid containing portion 60 in the guiding direction. The guided portions 72 provided in the liquid container 20 are guided by the guide portions 73 provided in the container 13 in the guiding direction.

In the present embodiment, the guide portion 73 protrude in a substantially semi-cylindrical shape, and a side surface of the guide portion 73 along the guiding direction has a planar restricting portion 73*a* positioned on the forward end side and a curved surface portion 73*b* positioned on the base end side as compared with the restricting portion 73*a*.

The guided portion 72 is recessed to conform the shape of the guide portion 73 and has a restricting portion 72*a* and a curved surface portion 72*b*. The restricting portions 72*a* and 73*a* restrict escape and rotation of the liquid container 20 placed on the container 13. Alternatively, the guide portions 73 of the container 13 may be recessed and the guided portions 72 of the liquid container 20 may be protruding.

Dome-shaped projections 75, for example, are formed on a forward end surface of the liquid supply portion 61. The projections 75 have beveled edges at least in the guiding direction. Engaging holes 76 to engage the projections 75 are formed on the forward plate 70 of the container 13. With this configuration, when the liquid container 20 is placed on the container 13, the user may be provided with tactile sense or feel (click feeling) that engagement between the container 13 and the liquid container 20 is completed. In the present embodiment, the projections 75 are disposed on both sides of the supply port 52 of the liquid supply portion 61 in the width direction, and the engaging holes 76 are disposed on both sides of the notch 65*a* of the container 13 in the width direction.

Figure 7:
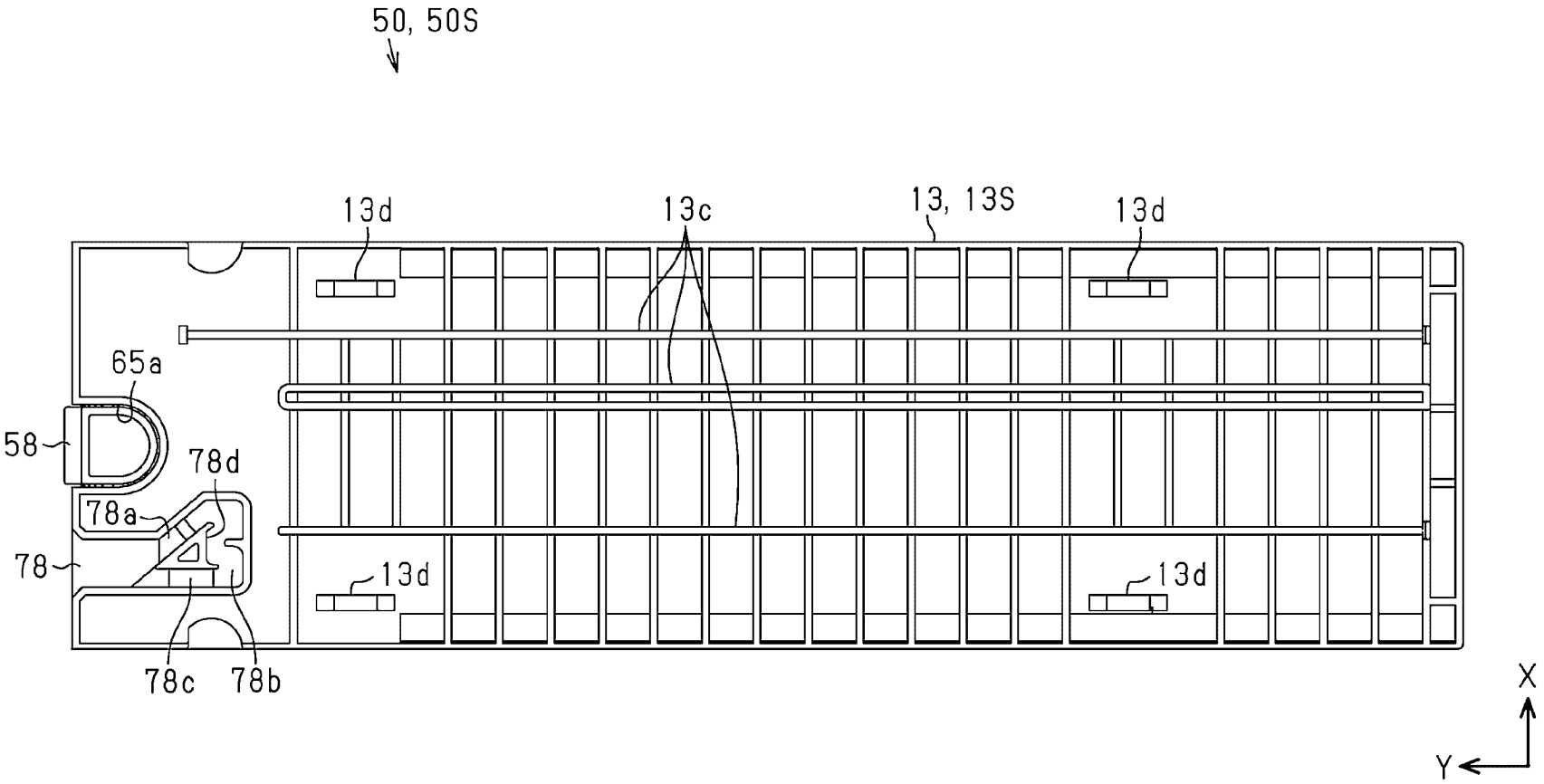
FIG. 7 is a bottom view of the first attachment of FIG. 5.
Figure 8:
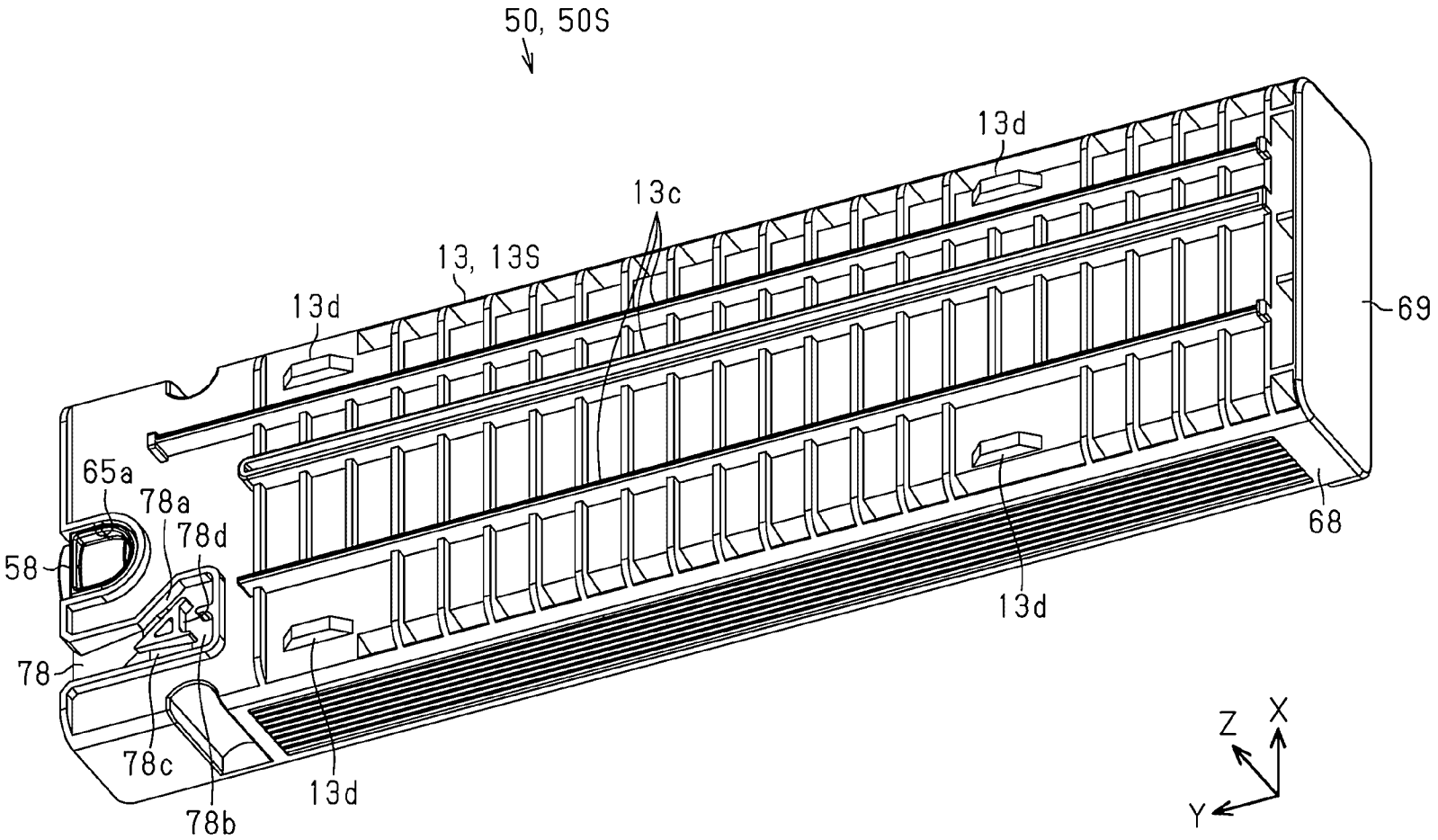
FIG. 8 is a perspective view of the first attachment of FIG. 5 seen from another angle.

Next, an attachment and removal structure of the container 13 with respect to the mounting portion 14 will be described. As illustrated in FIGS. 7 and 8, an engaging groove 78 is formed as a recess extending in the removing direction from the forward end on a bottom surface of the container 13. The engaging groove 78 desirably constitutes the connection structure 51, and is included in the first connection structure 51F (as one of the first connection structure 51F and the second connection structure 51S) in which the first positioning hole 55 as the positioning reference is also included.

The engaging groove 78 may be a heart cam groove which includes, for example, a first inclined groove 78*a* extending in the removing direction from the forward end of the bottom surface, a latch groove 78*b* extending in the width direction from a termination end of the first inclined groove 78*a*, and a second inclined groove 78*c* extending toward a starting end of the first inclined groove 78*a* from a termination end of the latch groove 78*b*. When the container 13 approaches a termination end of the moving path upon attachment to the mounting portion 14, the latching portion 39 provided to project at the distal end of the arm 38 engages the engaging groove 78.

The first inclined groove 78*a*, the latch groove 78*b*, and the second inclined groove 78*c* are inclined so that the grooves become shallower toward their termination ends from their starting ends, respectively, such that a step is formed in each crossing portion. Therefore, after the latching portion 39 engages the starting end of the first inclined groove 78*a* and the container 13 is moved in the attaching direction, the latching portion 39 engages the first inclined groove 78*a*, the latch groove 78*b*, and the second inclined groove 78*c* along the inclination in this order. Therefore, the latching portion 39 does not move back from the latch groove 78*b* to the first inclined groove 78*a*, or from the second inclined groove 78*c* to the latch groove 78*b*.

A portion of the latch groove 78*b* between the starting end and the termination end is bent toward the forward end and an engagement wall portion 78*d* is formed at the bent portion. The engagement wall portion 78*d* is positioned on the rear side of the latching portion 39 in the attaching direction and engages the latching portion 39. When the latching portion 39 engages the engagement wall portion 78*d*, the movement of the container 13 in the removing direction is restricted while receiving the urging force of the urging portion 47*c*, and the state where the container 13 is mounted on the mounting portion 14 is maintained.

When the container 13 is latched by the latching portion 39, attachment of the container 13 to the mounting portion 14 is completed. Since the container 13 is latched by the latching portion 39, the movement of the liquid container 20 engaging the container 13 from the mounting portion 14 in the removing direction is restricted.

Since a target which the latching portion 39 latches is the container 13, the container 13 alone may be mounted on the mounting portion 14 in addition to the attachment 50 which accommodates the liquid container 20. If the liquid container 20 alone is inserted into the accommodation space without engaging the container 13, the liquid container 20 is not latched by the latching portion 39, and the pressing portion 47*b* comes into contact with the forward end of the liquid supply portion 61 and is pressed back by the urging force of the urging portion 47*c*. Therefore, the liquid container 20 alone is not able to be mounted on the mounting portion 14.

If the container 13 alone is mounted on the mounting portion 14 without engaging the liquid container 20, the connection terminal 53 is not connected to the terminal portion 40. Therefore, the control device 42 may determine that the liquid container 20 is not connected to the connecting portion 32.

When the container 13 inserted into the accommodation space is pressed in the attaching direction by a user and relatively moved along the first inclined groove 78*a* with the latching portion 39 engaging the engaging groove 78, the container 13 receives the urging force of the urging portion 47*c*. Therefore, after the latching portion 39 is moved from the first inclined groove 78*a* to the latch groove 78*b* until the latching portion 39 engages the engagement wall portion 78*d*, the container 13 is moved in the removing direction slightly by the urging force of the urging portion 47*c*.

At the termination end of the movement in the removing direction, a tactile "click" response (contact sound) may be produced when the latching portion 39 comes into contact with the engagement wall portion 78*d*, for example. Then, the user may be provided with tactile sense or feel that the attachment of the container 13 is completed. Therefore, occurrence of defective attachment resulting from improper insertion of the container 13, for example, can be suppressed.

When the container 13 is pressed in the attaching direction by the user while the latching portion 39 engages the engagement wall portion 78*d*, the latching portion 39 is moved to the second inclined groove 78*c* along the inclination of the latch groove 78*b*, and then is moved toward the termination end of the second inclined groove 78*c* by the urging force of the urging portion 47*c* along the inclination of the second inclined groove 78*c*, such that engagement with the engaging groove 78 is released. Then, the container 13 is moved in the removing direction by the urging force of the urging portion 47*c* and a base end portion of the container 13 comes out of the frame 24 and the housing 12 through the insertion port 25.

If the liquid container 20 engages the container 13 at this time, the supply port 52 is separated from the connecting portion 32 and the connection of the liquid container 20 is released as the container 13 is moved in the removing direction by the urging force of the urging portion 47*c* and, the connection terminal 53 is separated from the terminal portion 40 and attachment of the liquid container 20 to mounting portion 14 is released.

Rail engaging portions 13*c* conforming to the projections and recesses of the guide rails 26 are desirably formed in the bottom portion of the container 13. With the guide rails 26, the moving path of the container 13 during attachment to the mounting portion 14 becomes clear and, if a plurality of attachments 50 or containers 13 are to be inserted into a single accommodation space, the adjacent attachments 50 or containers 13 may be moved without coming into contact with each other.

A distance between the guide rails 26 in the width direction or the number of the guide rails 26 may differ for each width of the container 13 to be mounted. In this case, since the containers 13 of the same width may have the rail engaging portions 13*c* of the same shape, the same member can be used in common. Alternatively, each of a plurality of sets of guide rails 26 may be different in distance between the guide rails 26 in the width direction or in the number of the guide rails 26 to suppress improper attachment of the containers 13.

Three or more (four in the present embodiment) legs 13*d* for keeping the position of the container 13 horizontal may desirably be provided to project from the bottom portion of the container 13. Therefore, since the container 13 may be positioned in the vertical direction, the liquid container 20 and the connecting portion 32 may be properly connected to each other. Since the position of the container 13 can be kept properly, the connection between the liquid container 20 and the connecting portion 32 may be properly maintained.

Figure 9:
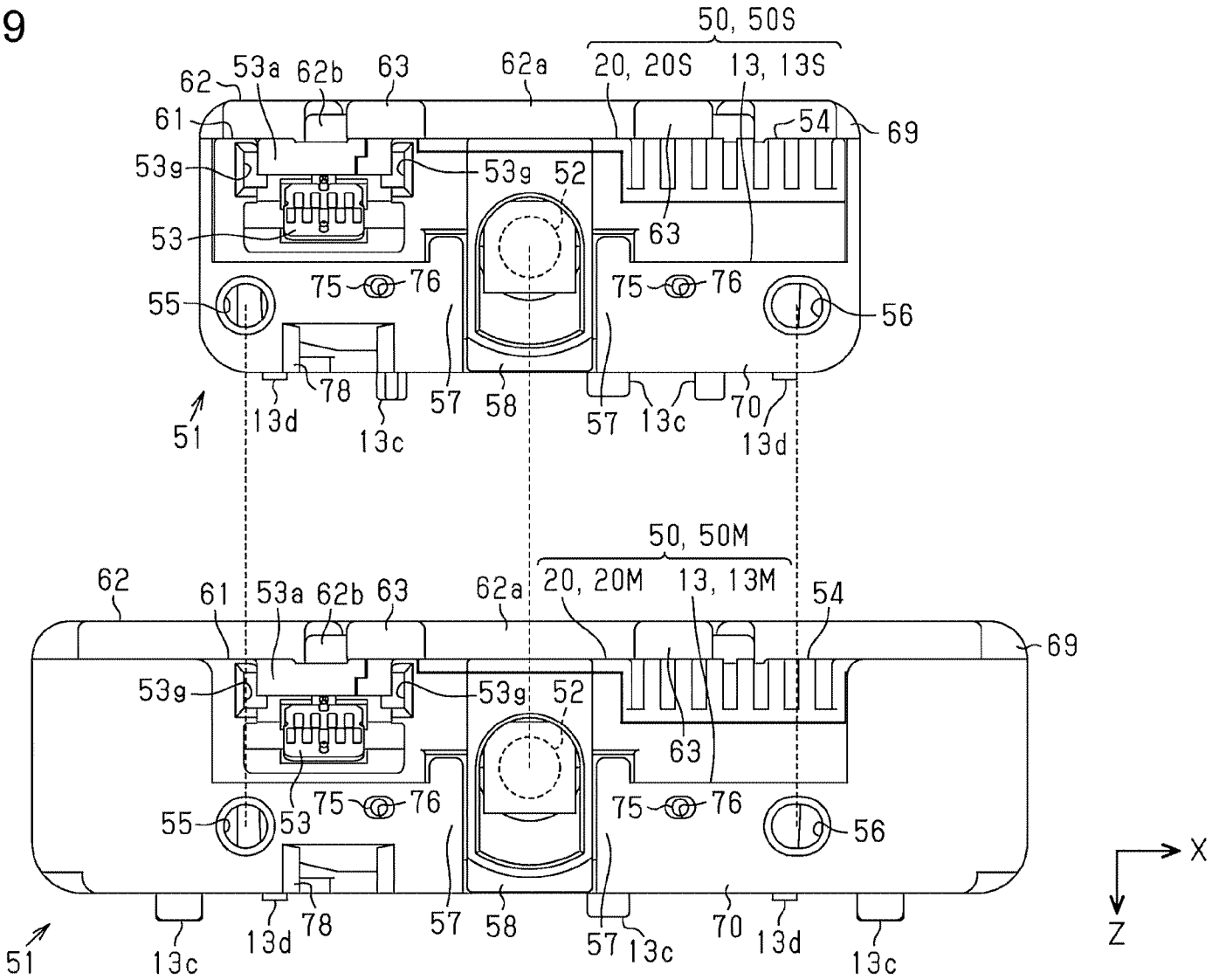
FIG. 9 is a front view of the first attachment of FIG. 5 and a second attachment having a different width than the first attachment.

Next, the liquid containers 20, the containers 13, and the attachments 50 with different widths will be described. As illustrated in FIG. 9, the attachment 50 in the present embodiment includes a first attachment 50S and a second attachment 50M with different lengths in the width direction. The liquid container 20 includes a first liquid container 20S and a second liquid container 20M which are different in length in the width direction and liquid capacity. The first attachment 50S is constituted by the first container 13S and the first liquid container 20S. The second attachment 50M is constituted by the second container 13M and the second liquid container 20M.

Figure 10:
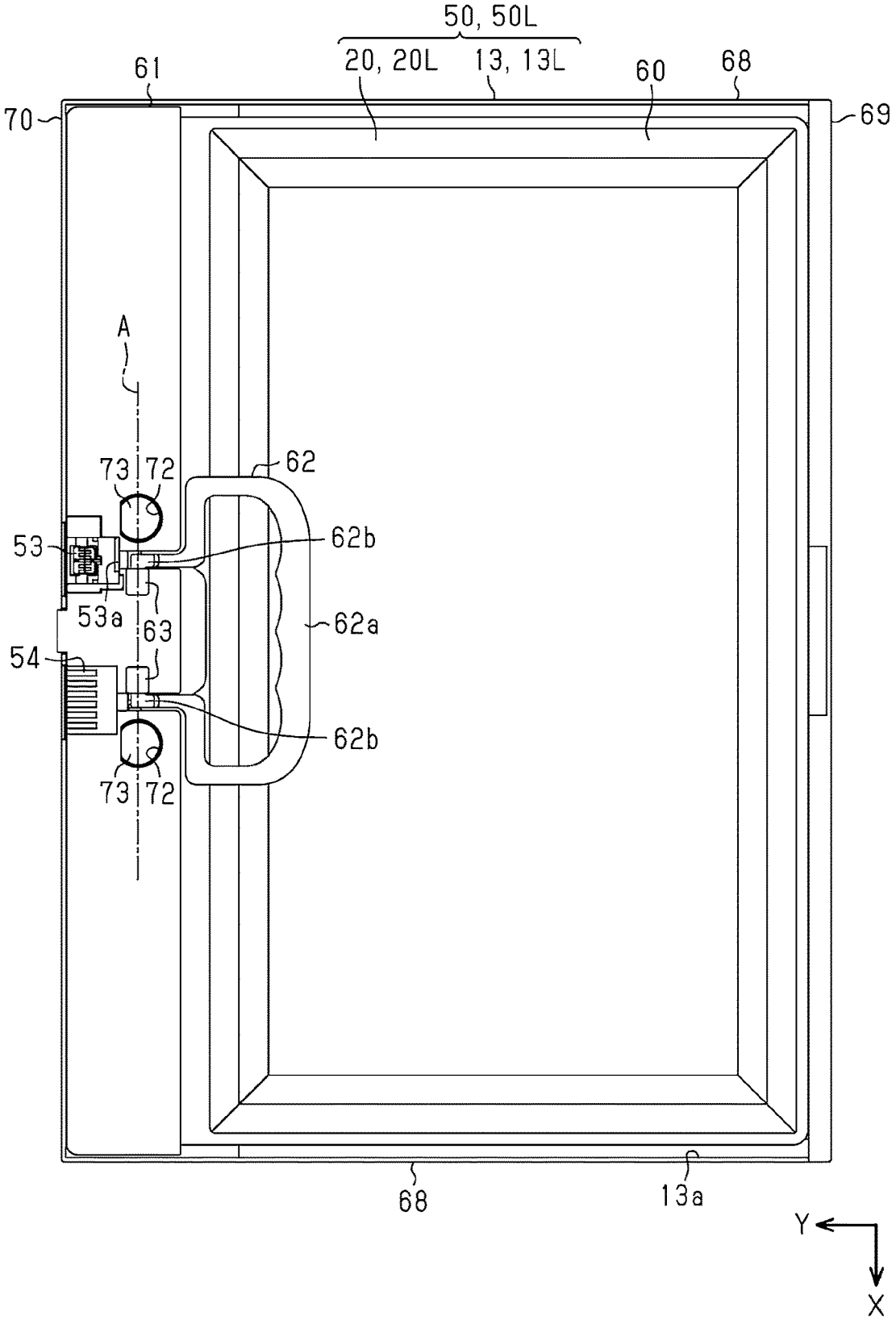
FIG. 10 is a top view of a third attachment.

Further, as illustrated in FIG. 10, a third attachment 50L may be constituted by combining a third liquid container 20L as the liquid container 20 with a third container 13L. The third liquid container 20L is a large-capacity liquid container 20 having greater liquid capacity than those of the small-capacity first liquid container 20S and the medium-capacity second liquid container 20M. The third container 13L is a large-sized container 13 having a width greater than those of the small-sized first container 13S and the middle-sized second container 13M. If the third attachment 50L is mounted, the entire accommodation space of the mounting portion 14 illustrated in FIG. 2 may be used. Alternatively, another mounting portion 14 may be disposed on the upper side in the vertical direction of the mounting portion 14 illustrated in FIG. 2, and a single connecting portion 32 and a single connection mechanism 29 may be disposed near the center of the another mounting portion 14 in the width direction, and the third attachment 50L may be mounted.

As illustrated in FIGS. 9 and 10, the first attachment 50S, the second attachment 50M, and the third attachment 50L are the same in height (the length in the vertical direction) and in depth (the length in the attaching direction), respectively. The second attachment 50M is longer than the first attachment 50S in the width direction, and the third attachment 50L is longer than the second attachment 50M in the width direction.

Three liquid containers 20S each contain cyan, magenta, and yellow ink and one second liquid container 20M contains black ink. The large-capacity third liquid container 20L may contain black ink and may be used for monochrome printing, for example.

In the attachment 50, even if the widths (the length in the width direction) of the containers 13 differ, arrangement and shape of the connection terminal 53, the identification member 54, the positioning holes 55 and 56, and the urging force receiving portion 57 which constitute the connection structure 51, and the position of the engaging groove 78 based on the supply port 52 are the same. Arrangement and shape of the guide portions 73 and the guided portions 72 of the second attachment 50M and the third attachment 50L are the same. Therefore, the second attachment 50M will be described in the following description, and description of the third attachment 50L will be omitted. The same reference numerals are used in FIG. 10.

Figure 11:
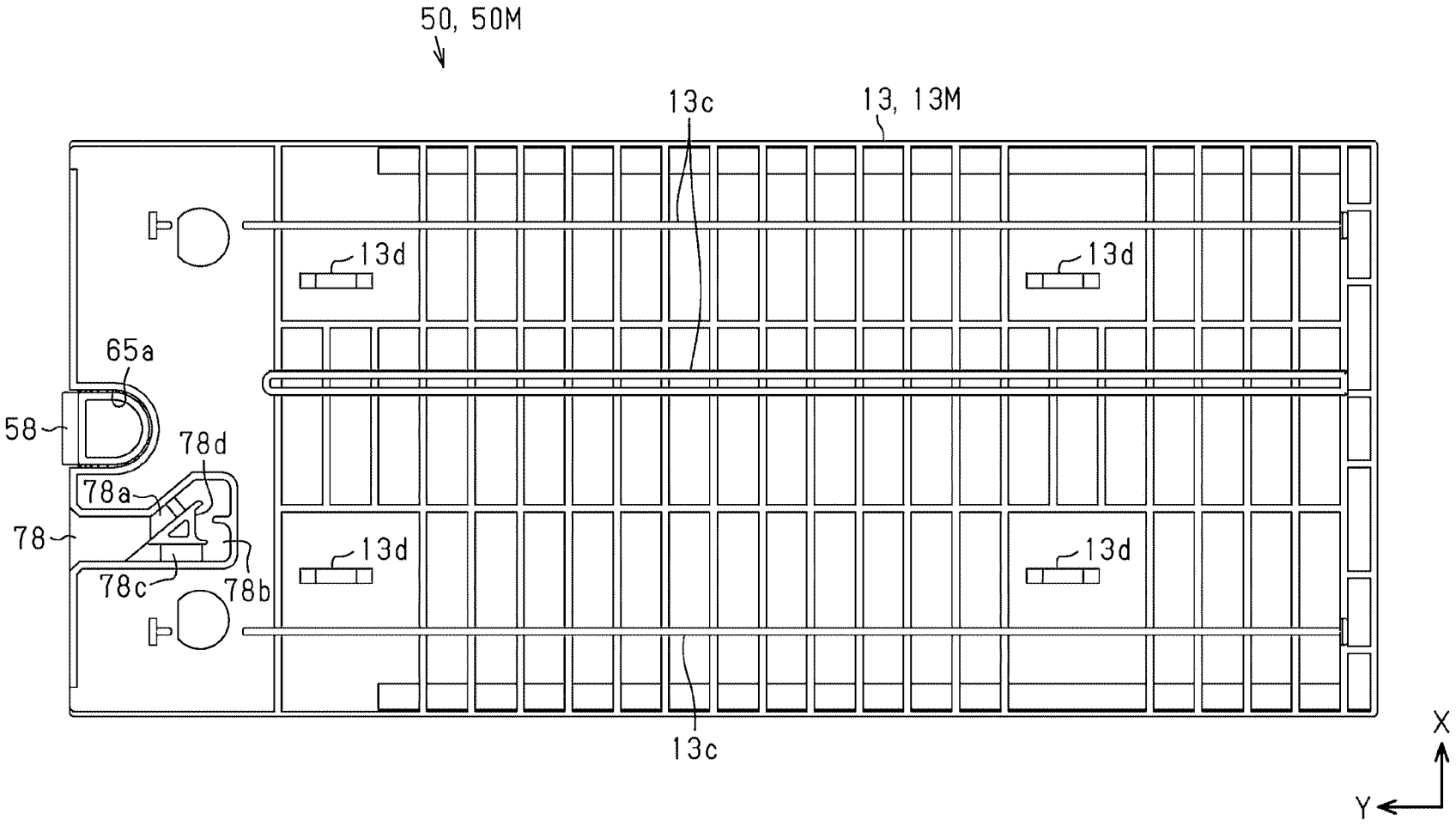
FIG. 11 is a bottom view of a second attachment.
Figure 12:
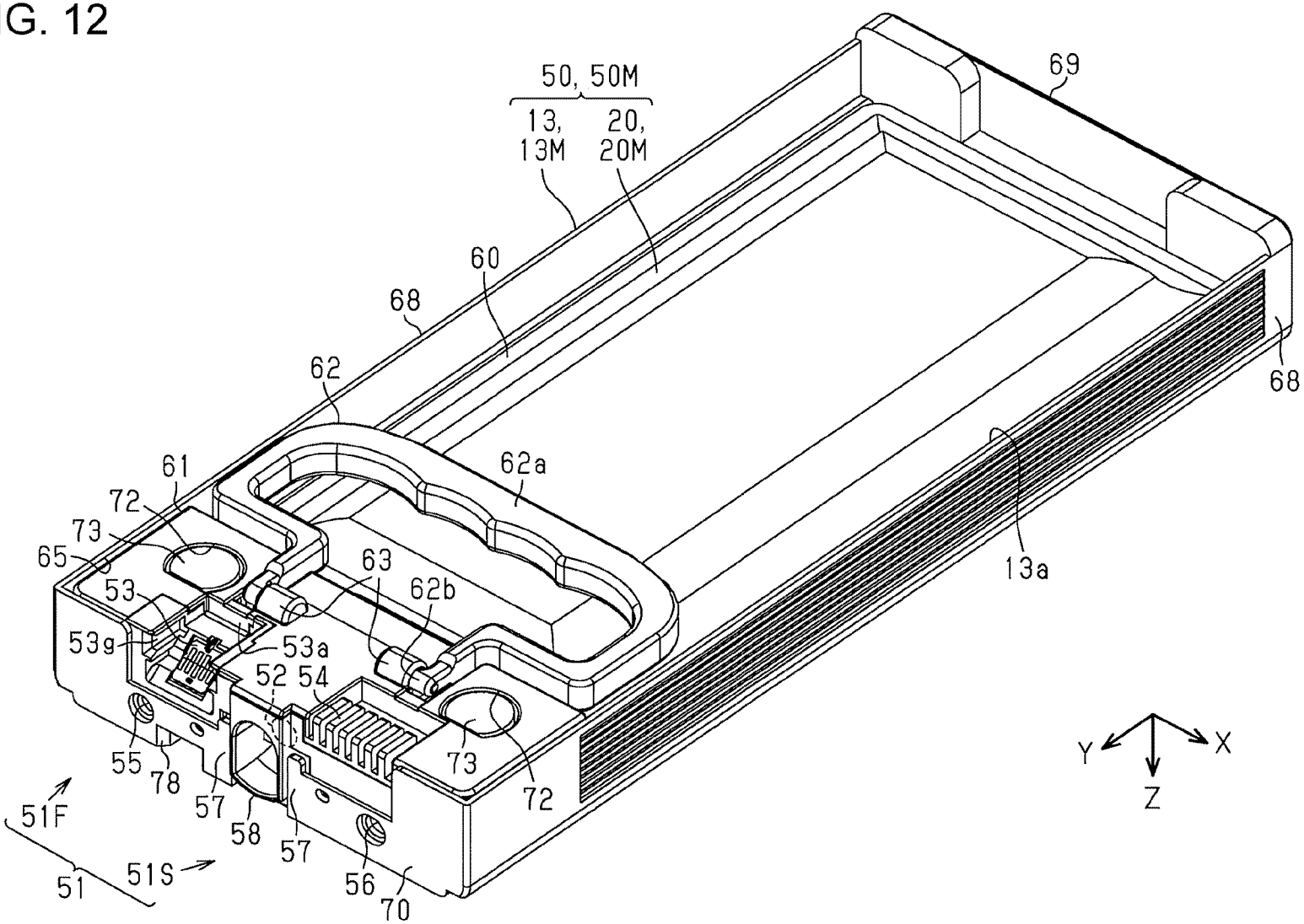
FIG. 12 is a perspective view of the second attachment of FIG. 11.
Figure 13:
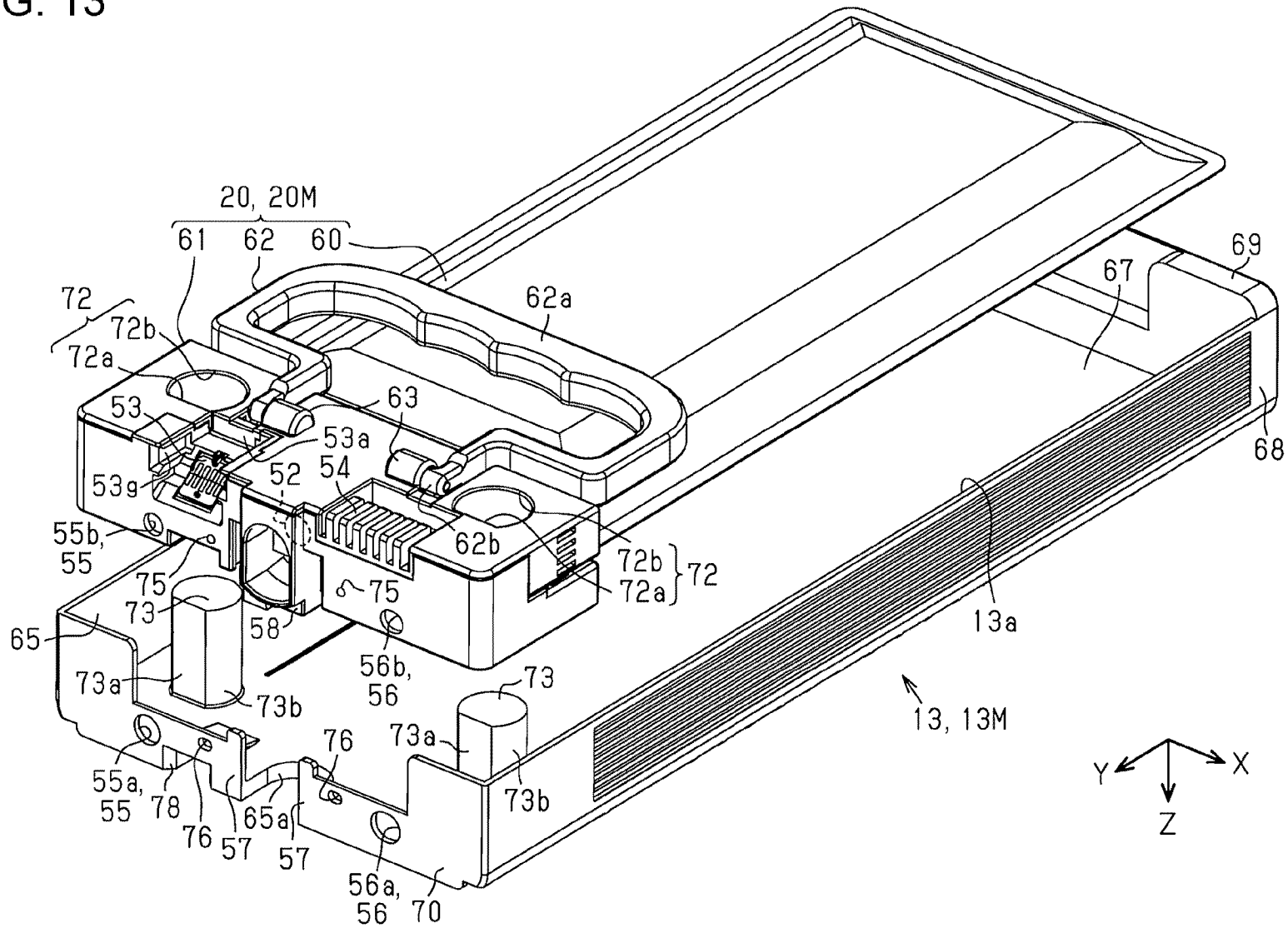
FIG. 13 is a perspective view of a second liquid container and a second container which constitute the second attachment of FIG. 11.

As illustrated in FIG. 11, in the second container 13M which constitutes the second attachment 50M, the shape of the engaging groove 78 is the same as that of the engaging groove 78 of the first container 13S illustrated in FIG. 7. As illustrated in FIGS. 12 and 13, in the liquid supply portion 61 of the second liquid container 20M, a plurality of (two in the present embodiment) substantially circular hole-shaped guided portions 72 are formed to penetrate in the guiding direction. In the engagement receiving portion 65 of the second container 13M, a plurality of (two in the present embodiment) substantially cylindrical guide portions 73 are provided to protrude from the bottom plate 67 in the guiding direction. The guide portions 73 of the second container 13M and the guided portions 72 of the second liquid container 20M have the restricting portions 72*a* and 73*a* and the curved surface portions 72*b* and 73*b* as the first container 13S and the first liquid container 20S do.

Figure 14:
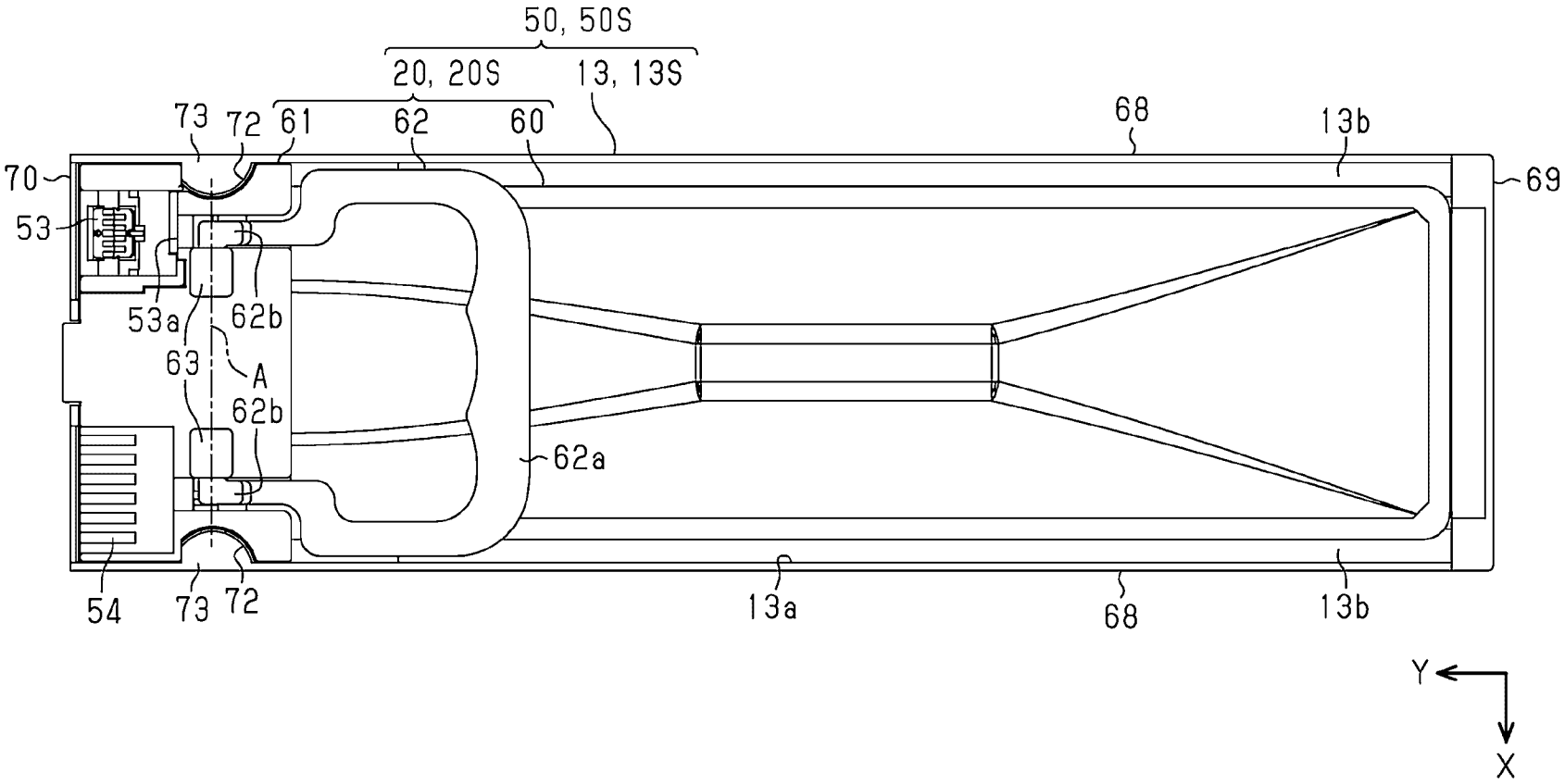
FIG. 14 is a top view of the first attachment of FIG. 5.
Figure 15:
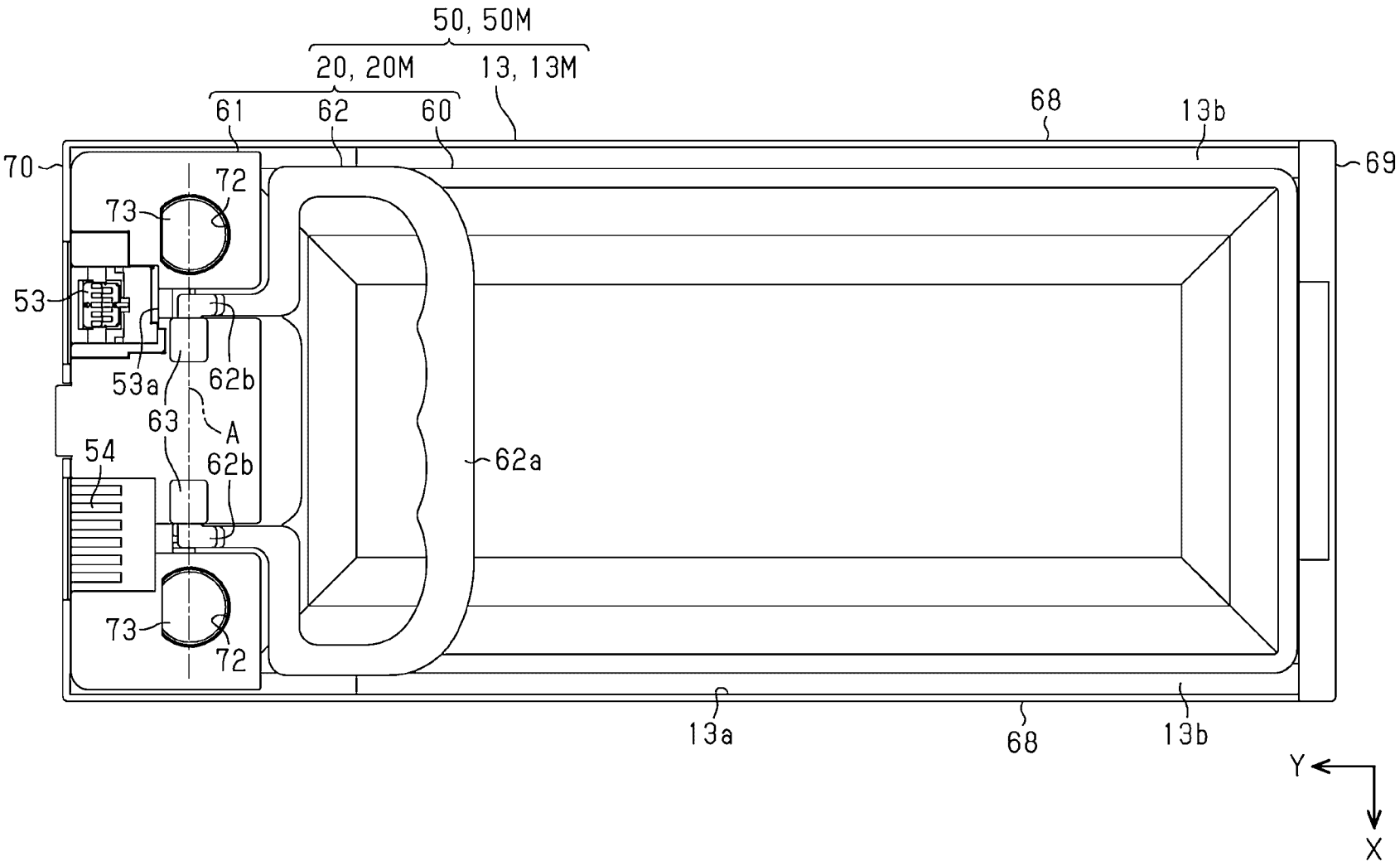
FIG. 15 is a top view of the second attachment of FIG. 11.

As illustrated in FIGS. 14 and 15, the shaft coupling 63 is disposed on a line A which connects the two guided portions 72 (depicted by the one-dot chain line in FIGS. 14 and 15). At least a part of the handle 62 (the shaft portion 62*b* in the present embodiment) is disposed on the line A which connects at least two guide portions 73 in a state where the liquid container 20 is placed on the container 13. At least a part of the handle 62 is disposed on the line A which connects the two guided portions 72. The two guide portions 73 and the two guided portions 72 are disposed at positions aligned with at least a part of the shaft coupling 63 in the direction which crosses the guiding direction (for example, the width direction). More desirably, the direction in which the line A extends in the same direction as the axial direction of the shaft coupling 63.

The container 13 and the liquid container 20 of the present embodiment are provided so that the guide portions 73 and the guided portions 72 hold at least a part of the handle 62 or the shaft coupling 63 in the width direction in a state where the liquid container 20 is placed on the container 13.

In the attachment position, the shaft coupling 63 and the shaft portion 62*b* are positioned closer to the forward end than the gripping portion 62*a*. Therefore, when removing the attachment 50 mounted on the mounting portion 14 from the mounting portion 14, the gripping portion 62*a* appears before the shaft coupling 63.

The size of the guide portion 73 and the guided portion 72 (the length in the depth direction or the width direction) is desirably greater than the thickness of the handle 62 in at least one of the guiding direction, the depth direction, and the width direction of the handle 62 in the first position. The size of the guide portion 73 and the guided portion 72 is desirably greater than the size of the shaft coupling 63 in at least one of the guiding direction, the depth direction, and the width direction. The guide portion 73 and the guided portion 72 in a top view are desirably larger than at least one of the connection terminal 53, the supply port 52, the positioning holes 55 and 56, the projections 75, and the engaging holes 76 when seen from the forward end. The size of the guide portion 73 of the first container 13S is substantially half the size of the guide portion 73 of the second container 13M.

Figure 16:
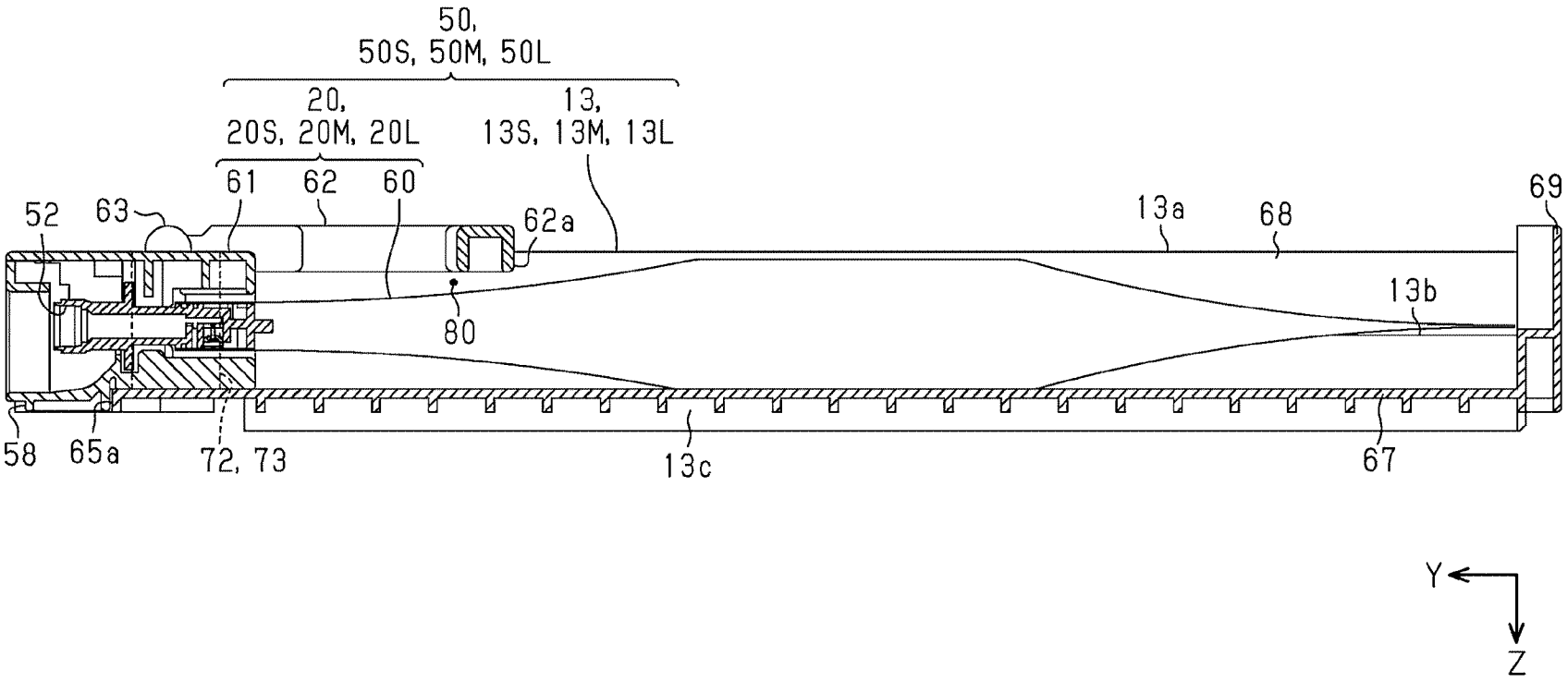
FIG. 16 is a cross-sectional view of an attachment.

As illustrated in FIG. 16, the liquid containing portion 60 swells at the center portion if a greater amount of liquid is contained therein, and becomes progressively thinner toward an outer edge. Therefore, the liquid containing portion 60 has the maximum height at the center portion and the height is progressively reduced toward the liquid supply portion 61 from the center portion. The liquid supply portion 61 has higher than an end of the liquid containing portion 60, and a recessed portion 80 is formed between the center portion of the liquid containing portion 60 and the liquid supply portion 61. Regarding the handle 62, the gripping portion 62*a* is desirably positioned above the liquid containing portion 60, and the gripping portion 62*a* is more desirably positioned above the recessed portion 80. With this configuration, the handle 62 is easy to grip, and the liquid container 20 can be easily attached to and removed from the container 13. Upon reduction of the liquid contained therein, the height of the liquid containing portion 60 is reduced and the shape of the recessed portion 80 changes.

Figure 17:
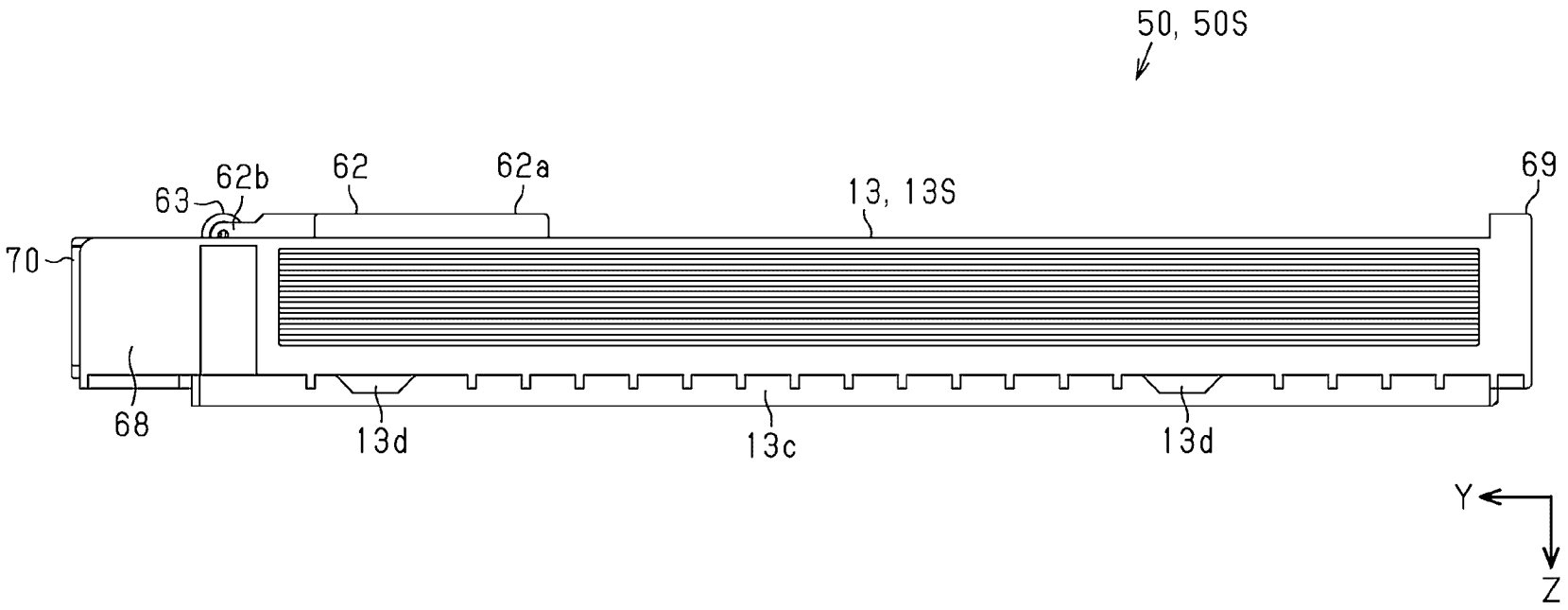
FIG. 17 is a side view of the first attachment of FIG. 5.
Figure 18:
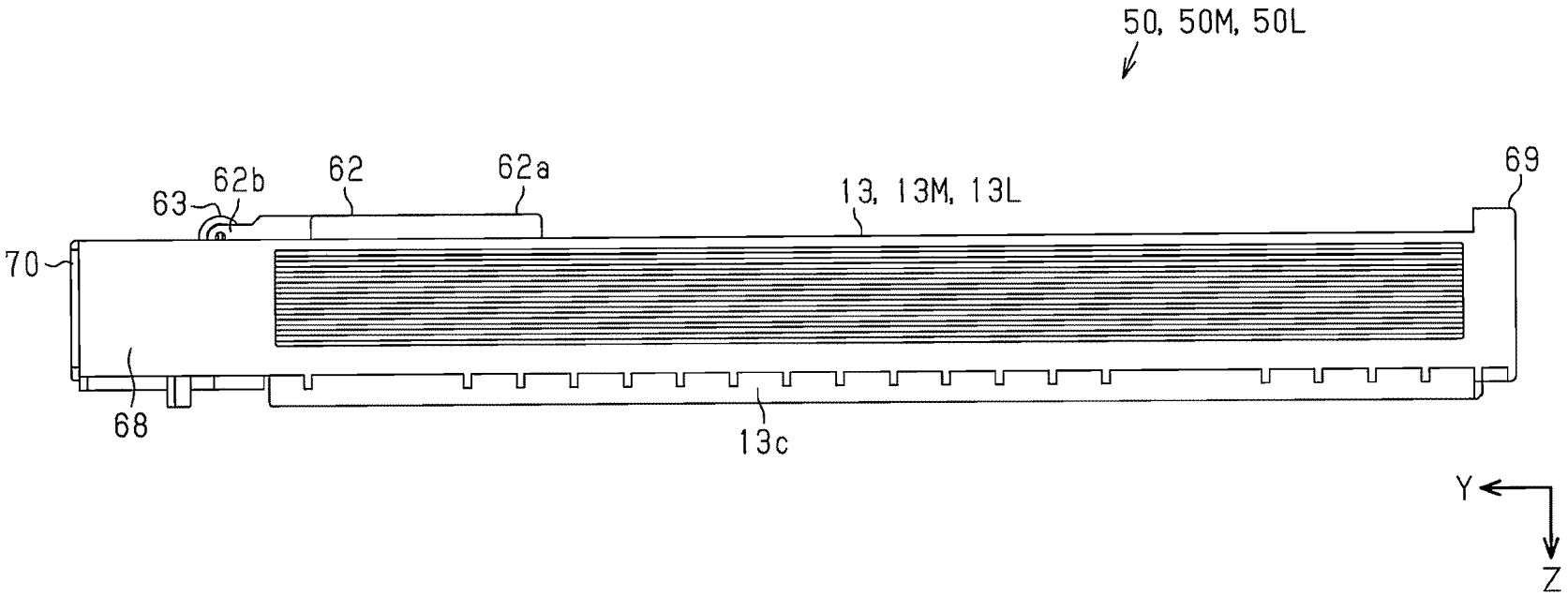
FIG. 18 is a side view of the second attachment of FIG. 11 and the third attachment of FIG. 10.

As illustrated in FIGS. 16 to 18, at least a part of the handle 62 is positioned higher than the liquid supply portion 61, the guided portions 72, and the guide portions 73 in the state where the liquid container 20 is placed on the container 13, and projects from the opening 13*a* of the container 13. The high position is a position on a distal end side of the guide portion 73 separated from the bottom surface of the container 13, and at which the guide portion 73 starts guidance of the guided portion 72.

In the container 13 of the present embodiment, the height of the front plate 69 is greater than those of the side plates 68 and the forward plate 70, and upper ends of the side plates 68 and the forward plate 70 are of the same height as that of the opening 13*a* of the container 13. In the attachment 50 in the attachment position, an upper end of the handle 62 in the first position and an upper end of the front plate 69 are of the same height. At least a part of the handle 62 is positioned higher than the supply port 52, the guide portions 73, the guided portions 72, the connection terminal 53, the identification member 54, the positioning holes 55 and 56, and the projections 75 (also see the FIG. 9).

Figure 19:
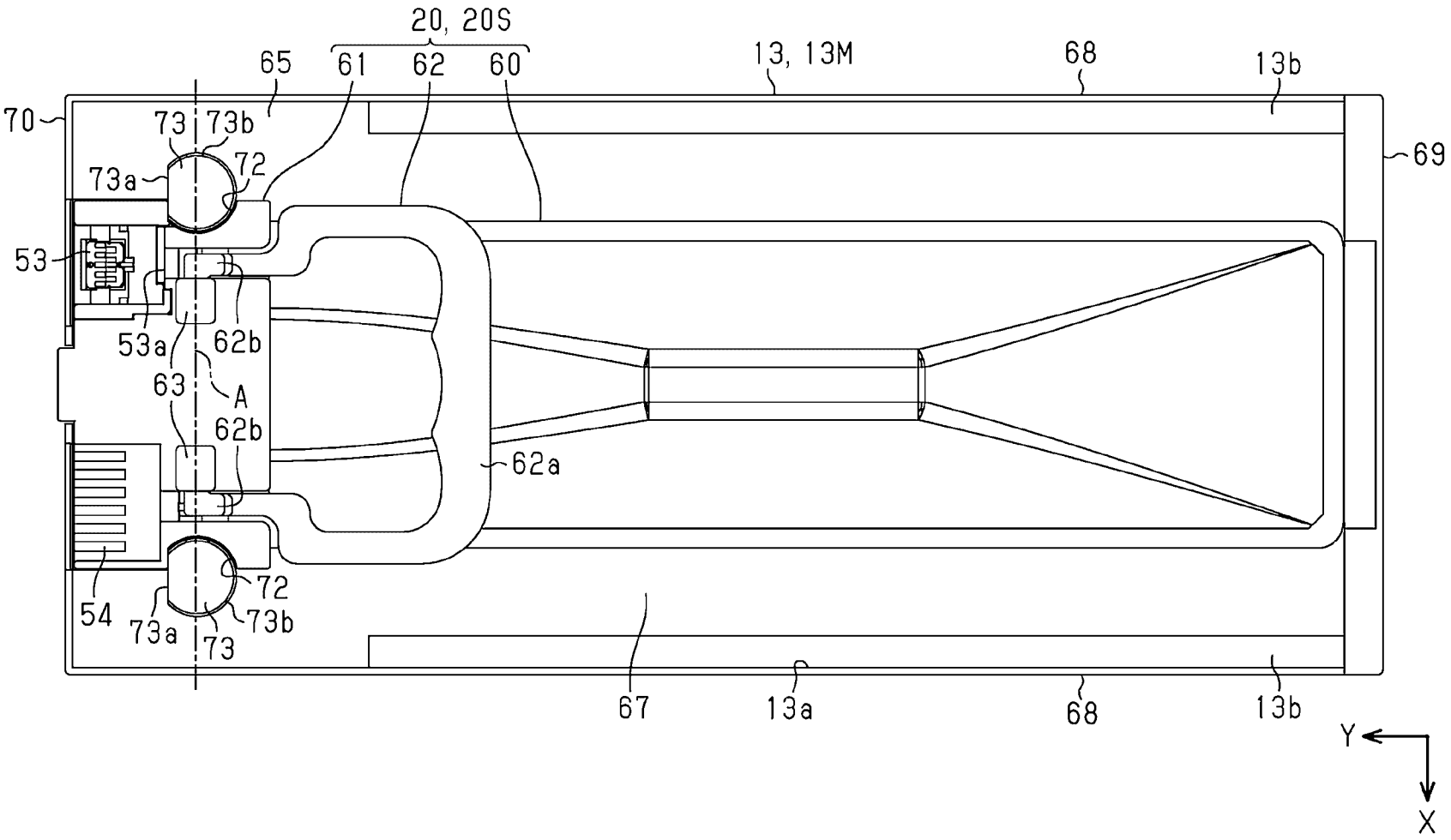
FIG. 19 is a top view illustrating the first liquid container placed on the second container.

As illustrated in FIG. 19, it is also possible to engage the liquid supply portion 61 of the first liquid container 20S with the engagement receiving portion 65 of the second container 13M or the third container 13L and then attach the second container 13M or the third container 13L to the mounting portion 14 (see FIG. 2). That is, the containers 13 of different widths are substantially the same in distance in the width direction of the guide portions 73, and the liquid containers 20 of different widths are substantially the same in distance in the width direction of the guided portions 72.

Guidance by the guide portions 73 may desirably be able to restrict the movement of the liquid supply portion 61 in a direction which crosses the guiding direction (for example, the width direction and the attaching direction), and a gap may exist between the guided portion 72 and the guide portion 73. Therefore, a distance between the guide portions 73 in the width direction in the second container 13M may be greater than a distance between the guide portions 73 in the width direction in the first container 13S. Alternatively, a distance between the guided portions 72 in the width direction in the first liquid container 20S may be shorter than a distance between the guided portions 72 in the width direction in the second liquid container 20M.

Next, an effect of the thus-configured liquid ejecting apparatus 11 will be described. The liquid container 20 for supplying the liquid to be ejected by the liquid ejecting portion 21 to the liquid ejecting apparatus 11 is mounted on the mounting portion 14 with the movement of the container 13 while being accommodated in the accommodation space of the container 13.

The base end side of the liquid container 20 may be bent upward when the liquid contained therein is reduced. Therefore, if the ceiling surface 27 of the insertion port 25 has a step, for example, the liquid container 20 may be caught. However, since the ceiling surface 27 is formed as a slope, the attachment 50 is removed from the mounting portion 14 with the upwardly bent base end of the liquid container 20 along the ceiling surface 27 (see FIG. 3).

Since the container 13 can be mounted on the mounting portion 14 with no liquid container 20 placed thereon, the container 13 may be mounted on the mounting portion 14 in an empty state when no liquid container 20 is placed thereon. Liquid containers 20 and containers 13 of different widths can be attached in various combinations by using the common supply portion 61 and engagement receiving portion 65.

According to the above embodiment, the following effects can be obtained.

(1) Since the handle 62 is positioned on the line A which connects the guide portions 73, the liquid container 20 in the state where the handle 62 is gripped can be guided by the guide portions 73 in a properly balanced manner. Therefore, the liquid container 20 can be easily attached to and removed from the container 13.

(2) Since at least a part of the handle 62 is positioned higher than the liquid supply portion 61, it is easy to guide the user to grip the handle 62. The liquid container 20 can be easily attached to and removed from the container 13 by making the user grip the handle 62.

(3) Since at least a part of the handle 62 is positioned higher than the guided portion 72, the liquid container 20 can be guided by the guide portions 73 and attached to and removed from the container 13 in the state where the handle 62 is gripped.

(4) Since the handle 62 is positioned on the line A which connects the guided portions 72, the liquid container 20 in the state where the handle 62 is gripped can be attached to and removed from the container 13 while being guided by the guide portions 73 in a properly balanced manner.

(5) Since the handle 62 and the liquid supply portion 61 are provided as separate members, a degree of freedom in design, such as the shape and the range of movement of the handle 62, is increased.

(6) The shaft coupling 63 is disposed on the line which connects the guided portions 72. Therefore, the liquid container 20 in the state where the handle 62 is gripped can be attached to and removed from the container 13 while being guided by the guide portions 73 in a properly balanced manner.

(7) Since at least a part of the handle 62 projects from the opening 13*a* of the container 13, it is easy to guide the user to grip the handle 62. The above embodiment may be changed as modifications described below. Each component of the liquid ejecting apparatus 11 of the above embodiment, each modification, and each component of the modifications may be combined with one another.

Figure 20:
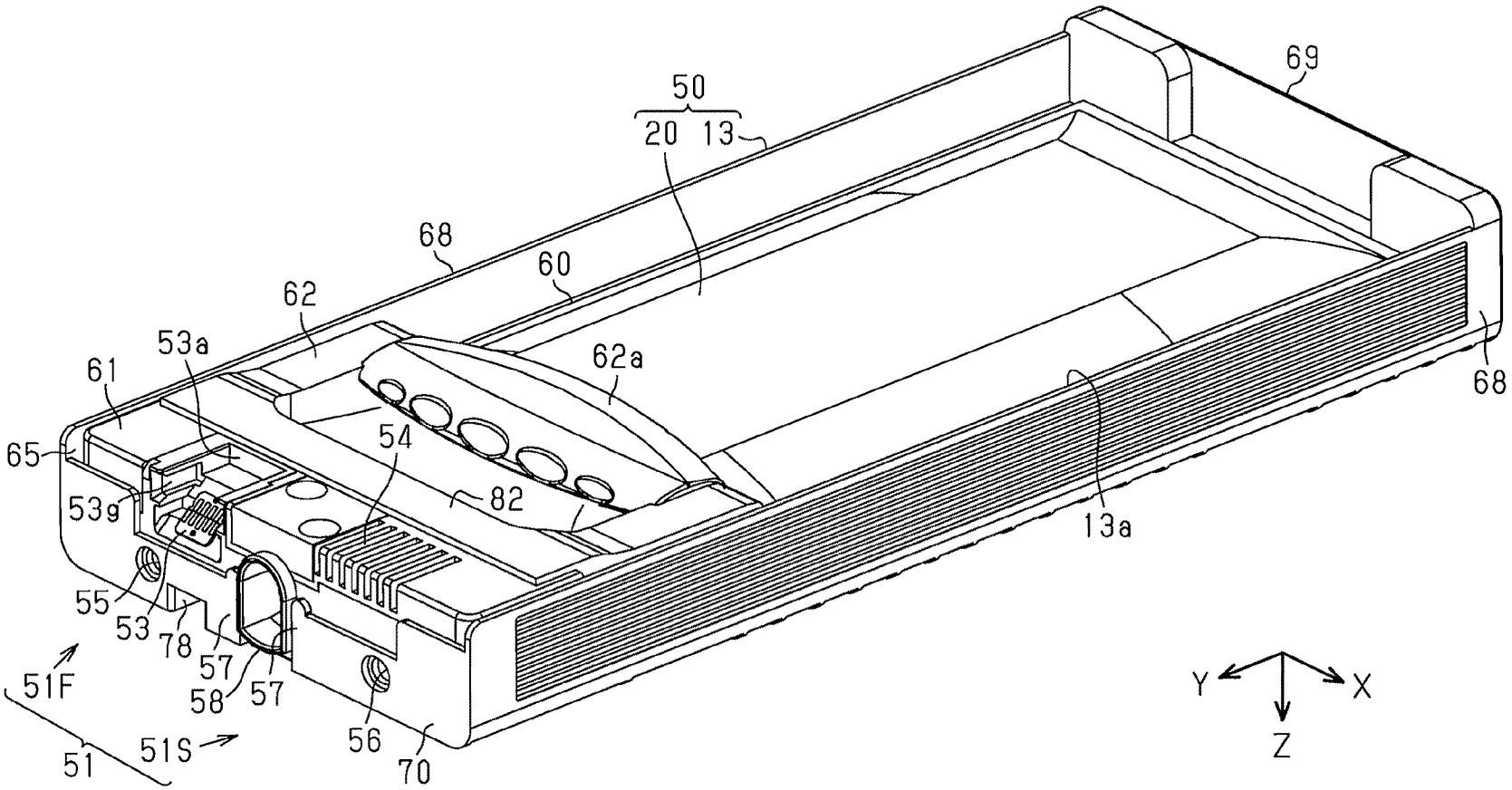
FIG. 20 is a perspective view of an attachment according to a first modification.

As illustrated in FIG. 20, the handle 62 is formed integrally with the liquid supply portion 61 and may be displaceable (a first modification). The handle 62 has a thin portion 82 which is thinner than the gripping portion 62*a* and is easy to bend. The handle 62 pivots about the thin portion 82 as a rotating shaft axis. According to the first modification, since the handle 62 and the liquid supply portion 61 are formed integrally with each other, the manufacturing cost is kept down. In an alternative configuration, no guide portion 73 and no guided portion 72 are provided.

Figure 21:
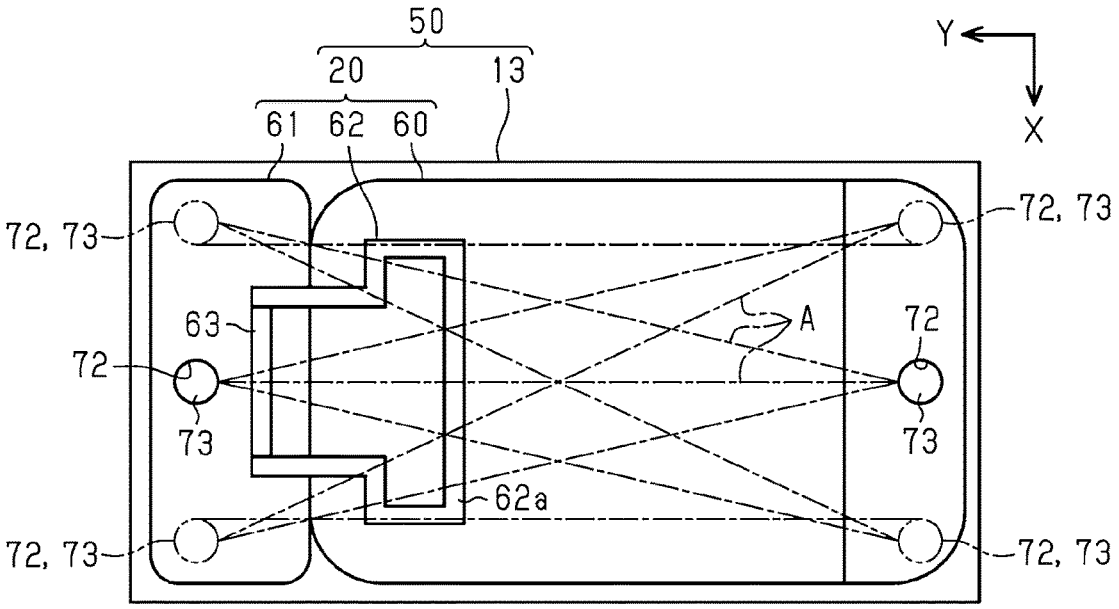
FIG. 21 is a top view of an attachment according to a second modification.
Figure 22:
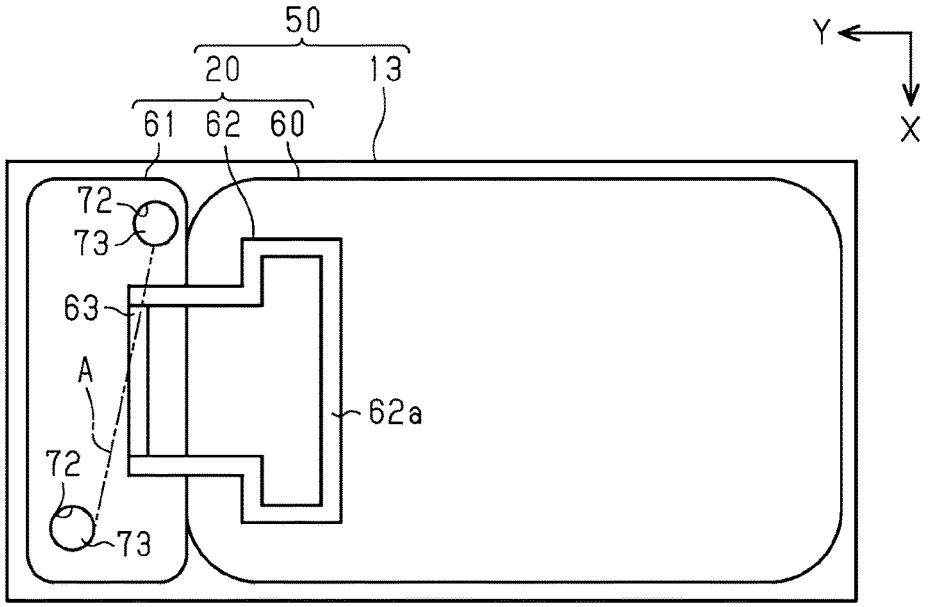
FIG. 22 is a top view of attachments according to the second modification and a third modification.
Figure 23:
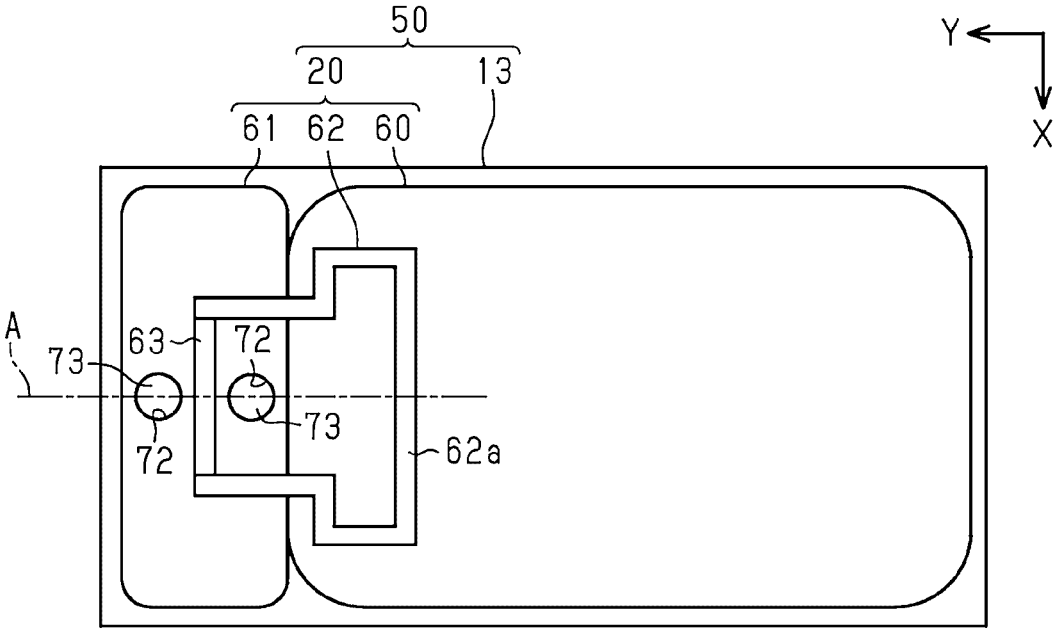
FIG. 23 is a top view of the attachments according to the second modification and the third modification.

As illustrated in FIGS. 21 to 23, a plurality of guide portions 73 and guided portions 72 may be formed at different positions in the depth direction (a second modification). Three or more guide portions 73 and guided portions 72 may be formed. At least a part of the handle 62 may be disposed on the line A which connects at least one guide portion 73 or guided portion 72 formed on the forward end side and at least one guide portion 73 or guided portion 72 formed on the base end side. The line A is a line which connects at least two guide portions 73 among a plurality of guide portions 73, and is also a line which connects at least two guided portions 72 among a plurality of guided portions 72. Therefore, the liquid container 20 in the state where the handle 62 is gripped can be guided by the guide portions 73 in a properly balanced manner, and the liquid container 20 can be easily attached to and removed from the container 13.

Figure 24:
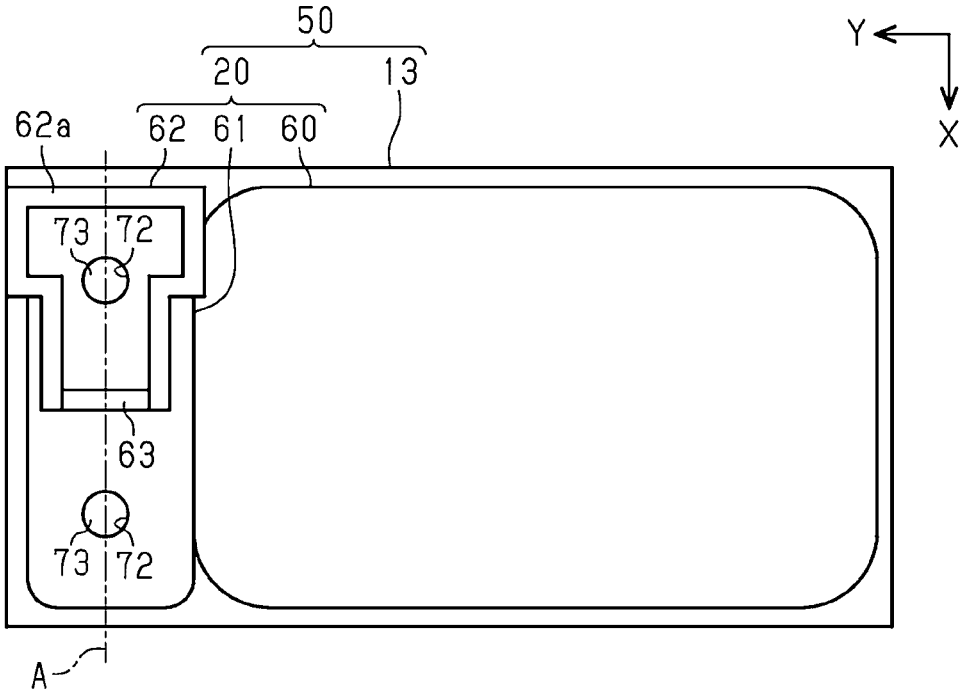
FIG. 24 is a top view of the attachment according to the third modification.
Figure 25:
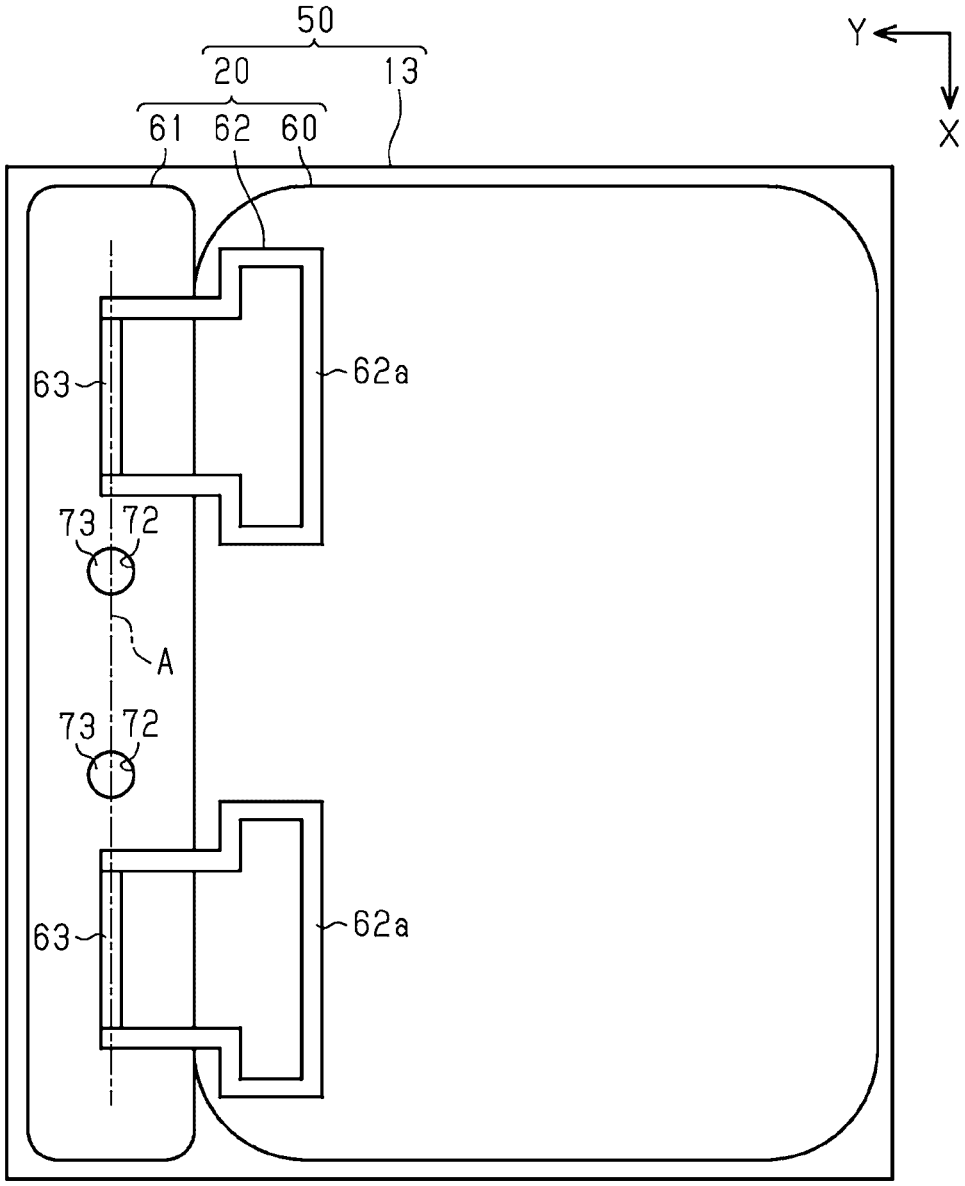
FIG. 25 is a top view of an attachment according to a fourth modification.

As illustrated in FIGS. 22 to 24, the handle 62 may be disposed so that an axis of the shaft coupling 63 and the line A which connects the guide portions 73 (for example, orthogonally) cross each other (a third modification).—As illustrated in FIG. 25, the liquid container 20 may include a plurality of handles 62 (a fourth modification). In any of the cases, the liquid container 20 in the state where the handle 62 is gripped can be guided by the guide portions 73 in a properly balanced manner, and the liquid container 20 can be easily attached to and removed from the container 13.

The handle 62 may be formed as a ring. The handle 62 may be cantilevered at one end by the liquid supply portion 61.—Ribs projecting from the bottom plate 67 may be formed and the guide portions 73 may be connected to each other by the ribs.

The container 13 may include an opening/closing cover which opens and closes the opening 13*a* through which the liquid container 20 is inserted or removed. The opening/closing cover may cover the entire or a part of the opening 13*a*. If the container 13 includes the opening/closing cover which opens and closes the opening 13*a*, the liquid container 20 can be inserted into and removed from the accommodation space through the opening 13*a* when the opening/closing cover is opened and, protrusion of the liquid container 20 from the opening 13*f* can be suppressed by closing the opening/closing cover when the container 13 is mounted on and removed from the mounting portion 14.

If the container 13 includes an opening/closing cover, the handle 62 may be positioned higher than the opening 13*a* when the opening/closing cover is removed or when the opening/closing cover pivots while covering a part of the opening 13*a* and takes the second position.

The shape of the guide portion 73 is not limited to substantially cylindrical, however, may be truncated cone, and truncated pyramid. The shape of the guide portion 73 in a plan view may be changed arbitrarily into elliptical, semicircular, rectangular, shapes of a star, a heart, a flower, and a cross, and a combination of circles of equal diameter or different diameters (for example, a shape of a snowman), for example. The shape of the guided portion 72 may desirably be a shape which can be guided by the guide portion 73, and may be the same or different from the shape of the guide portion 73. A plurality of guide portions 73 may be different in shape and a plurality of guided portions 72 may be different in shape.

An urging member for urging the handle 62 may be provided. The urging member may urge the handle 62 in the first position in a direction to pivot to the second position, for example.

The guided portion 72 is not limited to a through hole penetrating the liquid supply portion 61 from a bottom surface to an upper surface, however, may be a recess formed from the bottom surface.

The attachment 50 may take a placement position in which the liquid container 20 is placed on the container 13 and an attachment position in which the attachment 50 is mounted on the mounting portion 14. Each of these positions is different from each other.

A plurality of liquid containers 20 may be placed on a single container 13.

The size of the liquid container 20 and the container 13 is not limited to the three (small, medium, and large) described above and may be arbitrarily changed. The insertion ports 25 to the mounting portion 14 do not necessarily have to be disposed on the front surface of the housing 12. For example, the insertion ports 25 may be provided on the side surface extending in the depth direction of the housing 12. That is, the attaching direction of the attachments 50 is not limited to the depth direction of the housing 12, however, the width direction of the housing 12 may be the attaching direction of the attachments 50 and the containers 13. In this case, the depth direction of the housing 12 and the depth direction (the attaching direction) of the mounting portion 14 are different from each other.

In the attachment position, the guided portions 72 and the guide portions 73 may be positioned higher than the opening 13*a*.

The handle 62 may be movably connected to the liquid supply portion 61 with a connecting member, such as a string and a chain. The handle 62 may slide relative to the liquid supply portion 61.

The handle 62 does not necessarily have to pivot. That is, the handle 62 may be fixed to the liquid supply portion 61.

The shaft coupling 63 does not necessarily have to be disposed on the line A which connects the guided portions 72. The shaft coupling 63 may be provided so that, for example, the axis of the shaft coupling 63 and the line A which connects the guided portions 72 cross or coincide with each other.

In the attachment position illustrated in FIG. 16, the handle 62 may be positioned lower than the opening 13*a*, the guide portions 73, the guided portions 72, and the liquid supply portion 61, and does not necessarily have to project from the opening 13*a*. The handle 62 may be positioned higher than the opening 13*a* when it pivots about the shaft coupling 63 and takes the second position. That is, at least a part of the handle 62 is movable to a position higher than the guided portions 72, the guide portions 73, and the opening 13*a* in the state where the liquid container 20 is placed on the container 13. With this configuration, the handle 62 is easy to grip, and the liquid container 20 can be easily attached to and removed from the container 13.

When the handle 62 is in the second position, at least a part of the handle 62 may be disposed on the line A which connects the guided portions 72 or the guide portions 73.

The liquid ejected by the liquid ejecting portion is not limited to ink, however, may be a liquid material in which particles of a functional material are dispersed or mixed into a liquid, for example. Recording may be performed by ejecting a liquid material which includes an electrode material, a colorant (a pixel material), and so forth in the form of dispersion or dissolution used for manufacturing liquid crystal displays, electroluminescence (EL) displays, and surface-emitting displays, for example.

The medium is not limited to a paper sheet, however, may be a plastic film, a thin plate material, or fabric used in a fabric printing apparatus, for example. The medium is not limited to a sheet cut into a predetermined size, however, may be a roll-shaped medium rolled into a cylindrical shape, clothing of any shape, such as a T-shirt, and a three-dimensional object of any shape, such as tableware and stationery, for example.

The entire disclosure of Japanese Patent Application No. 2016-158443, filed Aug. 12, 2016 and No. 2016-203331, filed Oct. 17, 2016 are expressly incorporated by reference herein.

What is claimed is:

1. A container on which a liquid container provided with a handle is removably placed, wherein the container comprises:

a bottom plate and side plates, the side plates being connected to the bottom plate to form an open holding area structured to hold the liquid container when the liquid container is disposed therein; and a plurality of guide portions configured to extend inwardly towards the open holding area from the bottom plate and configured to guide corresponding guided portions provided on the liquid container in a guiding direction, wherein the guided portions are guided by the plurality of guide portions as the liquid container is being fitted into the container's open holding area, and wherein the plurality of guide portions are provided so that a line which connects at least two guide portions overlaps with at least a part of the handle in the guiding direction in a state where the liquid container is placed within the container.

2. A liquid ejecting apparatus, comprising:

the container according to claim 1;

an mounting portion on which the container is removably mounted; and a liquid ejecting portion configured to eject a liquid supplied from the liquid container placed on the container.

3. The container according to claim 1, wherein the at least two guide portions extend inwardly in a semi-cylindrical shape relative to the guiding direction.

4. A liquid container placed on a container which is removably mounted on a liquid ejecting apparatus, comprising:

a liquid containing portion capable of containing a liquid;

a liquid supply portion configured to supply the liquid in the liquid containing portion to the liquid ejecting apparatus; and a handle rotatably connected to the liquid supply portion, wherein:

the liquid containing portion includes a flexible part formed by a flexible member, and at least a part of the handle is positioned higher than the liquid supply portion in a state where the liquid container is placed within the container.

5. The liquid container according to claim 4, wherein:

the container includes a bottom plate, side plates, and a plurality of guide portions, the side plates being connected to the bottom plate to form an open holding area structured to hold the liquid container when the liquid container is disposed therein, the plurality of guide portions being configured to extend inwardly towards the open holding area from the bottom plate, the liquid supply portion includes a plurality of guided portions configured to be guided in a guiding direction by the plurality of guide portions, the plurality of guided portions being guided by the plurality of guide portions as the liquid container is being fitted into the open holding area, and at least a part of the handle is positioned higher than the plurality of guided portions in the state where the liquid container is placed within the container.

6. The liquid container according to claim 5, wherein a line connecting at least two guided portions overlaps with at least a part of the handle in the guiding direction.

7. The liquid container according to claim 4, wherein the handle and the liquid supply portion are provided as separate members and the handle is movable with respect to the liquid supply portion.

8. The liquid container according to claim 4, wherein the handle is formed integrally with the liquid supply portion and is displaceable.

9. The liquid container according to claim 4, wherein:

the liquid supply portion includes a plurality of guided portions configured to be guided in a guiding direction by a plurality of guide portions provided in the container, the handle is rotatably supported by a bearing portion provided in the liquid supply portion, and center axis of the bearing portion overlaps with a line which connects at least two guided portions in the guiding direction.

10. A liquid ejecting apparatus provided with the container on which the liquid container according to claim 4 is removably placed, wherein at least a part of the handle projects from an opening of the container in the state where the liquid container is placed within the container.

11. The liquid container according to claim 4, where the liquid containing portion, when filled with liquid, swells at a center portion and progressively thins towards outer edges of the liquid containing portion.

12. The liquid container according to claim 4, wherein:

the liquid containing portion has a bag formed by the flexible member, and the bag is connected to the liquid supply portion.

13. A liquid container placed on a container which is removably mounted on a liquid ejecting apparatus, comprising:

a liquid containing portion capable of containing a liquid;

a liquid supply portion configured to supply the liquid in the liquid containing portion to the liquid ejecting apparatus; and a handle rotatably connected to the liquid supply portion;

the liquid containing portion includes a flexible part formed by a flexible member; and wherein at least a part of the handle is movable to a position higher than the liquid supply portion in a state where the liquid container is placed within the container.

14. The liquid container according to claim 13, wherein:

the handle includes a grip portion which can be gripped by a user, and the grip portion is movable to a position higher than the liquid supply portion in the state where the liquid container is placed within the container.

15. The liquid container according to claim 13, wherein:

the liquid supply portion includes a guided portion configured to be guided in a guiding direction by a guide portion provided in the container, and at least a part of the handle is movable to a position higher than the guided portion in the state where the liquid container is placed within the container.

16. The liquid container according to claim 13, wherein at least a part of the handle is movable to a position higher than an opening of the container in the state where the liquid container is placed within the container.

17. The liquid container according to claim 13, wherein:

the liquid supply portion includes a plurality of guided portions configured to be guided in a guiding direction by a plurality of guide portions provided in the container, the handle is rotatably supported by a bearing portion provided in the liquid supply portion, and the plurality of guided portions are provided so that a line which connects at least two guided portions overlaps with at least a part of a center axis of the bearing portion in the guiding direction in the state where the liquid container is placed within the container.

18. The liquid container according to claim 13, wherein:

the handle includes a grip portion which can be gripped by a user, and the grip portion is positioned closer to a base end which is separated from the liquid supply portion in a mounting direction in which the liquid container placed on the container is mounted.

19. A liquid ejecting apparatus provided with the container on which the liquid container according to claim 13 is removably placed, wherein:

the handle includes a grip portion which can be gripped by a user, and the grip portion is movable to a position higher than an opening of the container in the state where the liquid container is placed within the container.

* * * * *